US010690296B2

(12) United States Patent
Amrine, Jr. et al.

(10) Patent No.: US 10,690,296 B2
(45) Date of Patent: Jun. 23, 2020

(54) LED-BASED LIGHT WITH CANTED OUTER WALLS

(71) Applicant: iLumisys, Inc., Troy, MI (US)

(72) Inventors: James M. Amrine, Jr., Ann Arbor, MI (US); John Ivey, Farmington Hills, MI (US)

(73) Assignee: iLumisys, Inc., Troy, MI (US)

( * ) Notice: Subject to any disclaimer, the term of this patent is extended or adjusted under 35 U.S.C. 154(b) by 0 days.

(21) Appl. No.: 16/223,762

(22) Filed: Dec. 18, 2018

(65) Prior Publication Data

US 2019/0120439 A1 Apr. 25, 2019

Related U.S. Application Data

(63) Continuation of application No. 14/826,505, filed on Aug. 14, 2015, now Pat. No. 10,161,568.

(Continued)

(51) Int. Cl.

| | |
|---|---|
| ***F21K 9/27*** | (2016.01) |
| ***F21V 23/02*** | (2006.01) |
| ***F21V 19/00*** | (2006.01) |
| ***F21V 23/06*** | (2006.01) |
| ***F21V 3/02*** | (2006.01) |
| ***F21K 9/66*** | (2016.01) |
| *F21V 17/10* | (2006.01) |
| *F21V 23/00* | (2015.01) |

(Continued)

(52) U.S. Cl.

CPC ..... *F21K 9/27* (2016.08); *F21K 9/66* (2016.08); *F21V 3/02* (2013.01); *F21V 19/003* (2013.01); *F21V 23/023* (2013.01); *F21V 23/06* (2013.01); *F21K 9/278* (2016.08); *F21K 9/60* (2016.08); *F21V 17/104* (2013.01); *F21V 19/0045* (2013.01); *F21V 23/006* (2013.01); *F21V 29/70* (2015.01); *F21Y 2101/00* (2013.01); *F21Y 2103/10* (2016.08); *F21Y 2115/10* (2016.08)

(58) Field of Classification Search

CPC . F21K 9/27; F21K 9/275; F21K 9/278; F21Y 2103/10

See application file for complete search history.

(56) References Cited

U.S. PATENT DOCUMENTS

| | | | |
|---|---|---|---|
| D79,814 | S | 11/1929 | Hoch |
| D80,419 | S | 1/1930 | Kramer |

(Continued)

FOREIGN PATENT DOCUMENTS

| | | |
|---|---|---|
| CN | 1584388 | 2/2005 |
| CN | 2766345 | 3/2006 |

(Continued)

OTHER PUBLICATIONS

United States Notice of Allowance issued in U.S. Appl. No. 14/826,505 dated Aug. 14, 2018, 8 pages.

(Continued)

*Primary Examiner* — Julie A Bannan

(74) *Attorney, Agent, or Firm* — Fish & Richardson P.C.

(57) ABSTRACT

An LED-based light has an elongate housing having a longitudinal axis and a vertical axis, the housing defined by a base and two canted outer walls meeting opposite the base, the housing defining a cavity. An LED circuit board on which a plurality of LEDs are located is positioned within the cavity. End caps are positioned at opposite ends of the housing.

10 Claims, 12 Drawing Sheets

Related U.S. Application Data

(60) Provisional application No. 62/169,050, filed on Jun. 1, 2015.

(51) Int. Cl.

| | |
|---|---|
| *F21Y 101/00* | (2016.01) |
| *F21V 29/70* | (2015.01) |
| *F21K 9/60* | (2016.01) |
| *F21Y 103/10* | (2016.01) |
| *F21Y 115/10* | (2016.01) |
| *F21K 9/278* | (2016.01) |

(56) References Cited

U.S. PATENT DOCUMENTS

D84,763 S 7/1931 Stange
D119,797 S 4/1940 Winkler et al.
D125,312 S 2/1941 Logan
2,826,679 A 3/1958 Rosenburg
2,909,097 A 10/1959 Alden et al.
3,178,622 A 4/1965 Paul et al.
3,272,977 A 9/1966 Holmes
3,318,185 A 5/1967 Kott
3,561,719 A 2/1971 Grindle
3,586,936 A 6/1971 Mcleroy
3,601,621 A 8/1971 Ritchie
3,612,855 A 10/1971 Juhnke
3,643,088 A 2/1972 Osteen et al.
3,739,336 A 6/1973 Burland
3,746,918 A 7/1973 Drucker et al.
3,818,216 A 6/1974 Larraburu
3,832,503 A 8/1974 Crane
3,858,086 A 12/1974 Anderson et al.
3,909,670 A 9/1975 Wakamatsu et al.
3,924,120 A 12/1975 Cox, III
3,958,885 A 5/1976 Stockinger et al.
3,969,720 A 7/1976 Nishino
3,974,637 A 8/1976 Bergey et al.
3,993,386 A 11/1976 Rowe
4,001,571 A 1/1977 Martin
4,054,814 A 10/1977 Fegley et al.
4,070,568 A 1/1978 Gala
4,082,395 A 4/1978 Donato et al.
4,096,349 A 6/1978 Donato
4,102,558 A 7/1978 Krachman
4,107,581 A 8/1978 Abernethy
4,189,663 A 2/1980 Schmutzer et al.
4,211,955 A 7/1980 Ray
4,241,295 A 12/1980 Williams, Jr.
4,261,029 A 4/1981 Mousset
4,262,255 A 4/1981 Kokei et al.
4,271,408 A 6/1981 Teshima et al.
4,271,458 A 6/1981 George, Jr.
4,272,689 A 6/1981 Crosby et al.
4,273,999 A 6/1981 Pierpoint
4,298,869 A 11/1981 Okuno
4,329,625 A 5/1982 Nishizawa et al.
4,339,788 A 7/1982 White et al.
4,342,947 A 8/1982 Bloyd
4,344,117 A 8/1982 Niccum
4,367,464 A 1/1983 Kurahashi et al.
D268,134 S 3/1983 Zurcher
4,382,272 A 5/1983 Quella et al.
4,388,567 A 6/1983 Yamazaki et al.
4,388,589 A 6/1983 Molldrem, Jr.
4,392,187 A 7/1983 Bornhorst
4,394,719 A 7/1983 Moberg
4,420,711 A 12/1983 Takahashi et al.
4,455,562 A 6/1984 Dolan et al.
4,500,796 A 2/1985 Quin
4,521,835 A 6/1985 Meggs et al.
4,531,114 A 7/1985 Topol et al.
4,581,687 A 4/1986 Nakanishi
4,587,459 A 5/1986 Frederick
4,597,033 A 6/1986 Meggs et al.
4,600,972 A 7/1986 MacIntyre
4,607,317 A 8/1986 Lin
4,622,881 A 11/1986 Rand
4,625,152 A 11/1986 Nakai
4,635,052 A 1/1987 Aoike et al.
4,647,217 A 3/1987 Havel
4,650,971 A 3/1987 Manecci et al.
4,656,398 A 4/1987 Michael et al.
4,661,890 A 4/1987 Watanabe et al.
4,668,895 A 5/1987 Schneiter
4,669,033 A 5/1987 Lee
4,675,575 A 6/1987 Smith et al.
4,682,079 A 7/1987 Sanders et al.
4,686,425 A 8/1987 Havel
4,687,340 A 8/1987 Havel
4,688,154 A 8/1987 Nilssen
4,688,869 A 8/1987 Kelly
4,695,769 A 9/1987 Schweickardt
4,698,730 A 10/1987 Sakai et al.
4,701,669 A 10/1987 Head et al.
4,705,406 A 11/1987 Havel
4,707,141 A 11/1987 Havel
D293,723 S 1/1988 Buttner
4,727,289 A 2/1988 Uchida
4,739,454 A 4/1988 Federgreen
4,740,882 A 4/1988 Miller
4,748,545 A 5/1988 Schmitt
4,753,148 A 6/1988 Johnson
4,758,173 A 7/1988 Northrop
4,765,708 A 8/1988 Becker et al.
4,771,274 A 9/1988 Havel
4,780,621 A 10/1988 Bartleucci et al.
4,794,373 A 12/1988 Harrison
4,794,383 A 12/1988 Havel
4,801,928 A 1/1989 Minter
4,810,937 A 3/1989 Havel
4,818,072 A 4/1989 Mohebban
4,824,269 A 4/1989 Havel
4,837,565 A 6/1989 White
4,843,627 A 6/1989 Stebbins
4,845,481 A 7/1989 Havel
4,845,745 A 7/1989 Havel
4,847,536 A 7/1989 Lowe et al.
4,851,972 A 7/1989 Altman
4,854,701 A 8/1989 Noll et al.
4,857,801 A 8/1989 Farrell
4,863,223 A 9/1989 Weissenbach et al.
4,870,325 A 9/1989 Kazar
4,874,320 A 10/1989 Freed et al.
4,887,074 A 12/1989 Simon et al.
4,894,832 A 1/1990 Colak
4,901,207 A 2/1990 Sato et al.
4,904,988 A 2/1990 Nesbit et al.
4,912,371 A 3/1990 Hamilton
4,920,459 A 4/1990 Rothwell, Jr. et al.
4,922,154 A 5/1990 Cacoub
4,929,936 A 5/1990 Friedman et al.
4,934,852 A 6/1990 Havel
4,941,072 A 7/1990 Yasumoto et al.
4,943,900 A 7/1990 Gartner
4,962,687 A 10/1990 Belliveau et al.
4,965,561 A 10/1990 Havel
4,973,835 A 11/1990 Kurosu et al.
4,977,351 A 12/1990 Bavaro et al.
4,979,081 A 12/1990 Leach et al.
4,979,180 A 12/1990 Muncheryan
4,980,806 A 12/1990 Taylor et al.
4,991,070 A 2/1991 Stob
4,992,704 A 2/1991 Stinson
5,003,227 A 3/1991 Nilssen
5,008,595 A 4/1991 Kazar
5,008,788 A 4/1991 Palinkas
5,010,459 A 4/1991 Taylor et al.
5,018,054 A 5/1991 Ohashi et al.
5,027,037 A 6/1991 Wei
5,027,262 A 6/1991 Freed
5,032,960 A 7/1991 Katoh
5,034,807 A 7/1991 Von Kohorn
5,036,248 A 7/1991 McEwan et al.

(56) References Cited

U.S. PATENT DOCUMENTS 5,038,255 A 8/1991 Nishihashi et al.
5,065,226 A 11/1991 Kluitmans et al.
5,072,216 A 12/1991 Grange
5,078,039 A 1/1992 Tulk et al.
5,083,063 A 1/1992 Brooks
5,088,013 A 2/1992 Revis
5,089,748 A 2/1992 Ihms
5,103,382 A 4/1992 Kondo et al.
5,122,733 A 6/1992 Havel
5,126,634 A 6/1992 Johnson
5,128,595 A 7/1992 Hara
5,130,909 A 7/1992 Gross
5,134,387 A 7/1992 Smith et al.
5,136,483 A 8/1992 Schoniger et al.
5,140,220 A 8/1992 Hasegawa
5,142,199 A 8/1992 Elwell
5,151,679 A 9/1992 Dimmick
5,154,641 A 10/1992 McLaughlin
5,161,879 A 11/1992 McDermott
5,161,882 A 11/1992 Garrett
5,164,715 A 11/1992 Kashiwabara et al.
5,184,114 A 2/1993 Brown
5,194,854 A 3/1993 Havel
5,198,756 A 3/1993 Jenkins et al.
5,209,560 A 5/1993 Taylor et al.
5,220,250 A 6/1993 Szuba
5,225,765 A 7/1993 Callahan et al.
5,226,723 A 7/1993 Chen
5,254,910 A 10/1993 Yang
5,256,948 A 10/1993 Boldin et al.
5,278,542 A 1/1994 Smith et al.
5,281,961 A 1/1994 Elwell
5,282,121 A 1/1994 Bornhorst et al.
5,283,517 A 2/1994 Havel
5,287,352 A 2/1994 Jackson et al.
5,294,865 A 3/1994 Haraden
5,298,871 A 3/1994 Shimohara
5,301,090 A 4/1994 Hed
5,303,124 A 4/1994 Wrobel
5,307,295 A 4/1994 Taylor et al.
5,321,593 A 6/1994 Moates
5,323,226 A 6/1994 Schreder
5,329,431 A 7/1994 Taylor et al.
5,341,988 A 8/1994 Rein et al.
5,344,068 A 9/1994 Haessig
5,350,977 A 9/1994 Hamamoto et al.
5,357,170 A 10/1994 Luchaco et al.
5,365,411 A 11/1994 Rycroft et al.
5,371,618 A 12/1994 Tai et al.
5,374,876 A 12/1994 Horibata et al.
5,375,043 A 12/1994 Tokunaga
D354,360 S 1/1995 Murata
5,381,074 A 1/1995 Rudzewicz et al.
5,388,357 A 2/1995 Malita
5,402,702 A 4/1995 Hata
5,404,094 A 4/1995 Green et al.
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,473,522 A 12/1995 Kriz et al.
5,475,300 A 12/1995 Havel
5,481,441 A 1/1996 Stevens
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,539,628 A 7/1996 Seib
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,684,523 A 11/1997 Satoh et al.
5,688,042 A 11/1997 Madadi et al.
5,697,695 A 12/1997 Lin et al.
5,699,243 A 12/1997 Eckel et al.
5,701,058 A 12/1997 Roth
5,712,650 A 1/1998 Barlow
5,713,655 A 2/1998 Blackman
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,781,108 A 7/1998 Jacob et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,831,522 A 11/1998 Weed et al.
5,836,676 A 11/1998 Ando et al.
5,841,177 A 11/1998 Komoto et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes

(56) References Cited

U.S. PATENT DOCUMENTS

| | | | |
|---|---|---|---|
| RE36,030 | E | 1/1999 | Nadeau |
| 5,859,508 | A | 1/1999 | Ge et al. |
| 5,865,529 | A | 2/1999 | Yan |
| 5,870,233 | A | 2/1999 | Benz et al. |
| 5,890,794 | A | 4/1999 | Abtahi et al. |
| 5,896,010 | A | 4/1999 | Mikolajczak et al. |
| 5,904,415 | A | 5/1999 | Robertson et al. |
| 5,907,742 | A | 5/1999 | Johnson et al. |
| 5,909,378 | A | 6/1999 | De Milleville |
| 5,912,653 | A | 6/1999 | Fitch |
| 5,917,287 | A | 6/1999 | Haederle et al. |
| 5,917,534 | A | 6/1999 | Rajeswaran |
| 5,921,660 | A | 7/1999 | Yu |
| 5,924,784 | A | 7/1999 | Chliwnyj et al. |
| 5,927,845 | A | 7/1999 | Gustafson et al. |
| 5,934,792 | A | 8/1999 | Camarata |
| 5,936,599 | A | 8/1999 | Reymond |
| 5,943,802 | A | 8/1999 | Tijanic |
| 5,946,209 | A | 8/1999 | Eckel et al. |
| 5,949,347 | A | 9/1999 | Wu |
| 5,951,145 | A | 9/1999 | Iwasaki et al. |
| 5,952,680 | A | 9/1999 | Strite |
| 5,959,547 | A | 9/1999 | Tubel et al. |
| 5,961,072 | A | 10/1999 | Bodle |
| 5,962,989 | A | 10/1999 | Baker |
| 5,962,992 | A | 10/1999 | Huang et al. |
| 5,963,185 | A | 10/1999 | Havel |
| 5,966,069 | A | 10/1999 | Zmurk et al. |
| 5,971,597 | A | 10/1999 | Baldwin et al. |
| 5,973,594 | A | 10/1999 | Baldwin et al. |
| 5,974,553 | A | 10/1999 | Gandar |
| 5,980,064 | A | 11/1999 | Metroyanis |
| 5,998,925 | A | 12/1999 | Shimizu et al. |
| 5,998,928 | A | 12/1999 | Hipp |
| 6,000,807 | A | 12/1999 | Moreland |
| 6,007,209 | A | 12/1999 | Pelka |
| 6,008,783 | A | 12/1999 | Kitagawa et al. |
| 6,010,228 | A | 1/2000 | Blackman et al. |
| 6,011,691 | A | 1/2000 | Schreffler |
| 6,016,038 | A | 1/2000 | Mueller et al. |
| 6,018,237 | A | 1/2000 | Havel |
| 6,019,493 | A | 2/2000 | Kuo et al. |
| 6,020,825 | A | 2/2000 | Chansky et al. |
| 6,025,550 | A | 2/2000 | Kato |
| 6,028,694 | A | 2/2000 | Schmidt |
| 6,030,099 | A | 2/2000 | McDermott |
| 6,031,343 | A | 2/2000 | Recknagel et al. |
| D422,737 | S | 4/2000 | Orozco |
| 6,056,420 | A | 5/2000 | Wilson et al. |
| 6,068,383 | A | 5/2000 | Robertson et al. |
| 6,069,597 | A | 5/2000 | Hansen |
| 6,072,280 | A | 6/2000 | Allen |
| 6,074,074 | A | 6/2000 | Marcus |
| 6,084,359 | A | 7/2000 | Hetzel et al. |
| 6,086,220 | A | 7/2000 | Lash et al. |
| 6,091,200 | A | 7/2000 | Lenz |
| 6,092,915 | A | 7/2000 | Rensch |
| 6,095,661 | A | 8/2000 | Lebens et al. |
| 6,097,352 | A | 8/2000 | Zavracky et al. |
| 6,107,755 | A | 8/2000 | Katyl et al. |
| 6,116,748 | A | 9/2000 | George |
| 6,121,875 | A | 9/2000 | Hamm et al. |
| 6,127,783 | A | 10/2000 | Pashley et al. |
| 6,132,072 | A | 10/2000 | Turnbull et al. |
| 6,135,604 | A | 10/2000 | Lin |
| 6,135,620 | A | 10/2000 | Marsh |
| 6,139,174 | A | 10/2000 | Butterworth |
| 6,149,283 | A | 11/2000 | Conway et al. |
| 6,150,774 | A | 11/2000 | Mueller et al. |
| 6,151,529 | A | 11/2000 | Batko |
| 6,153,985 | A | 11/2000 | Grossman |
| 6,158,882 | A | 12/2000 | Bischoff, Jr. |
| 6,166,496 | A | 12/2000 | Lys et al. |
| 6,175,201 | B1 | 1/2001 | Sid |
| 6,175,220 | B1 | 1/2001 | Billig et al. |
| 6,181,126 | B1 | 1/2001 | Havel |
| D437,947 | S | 2/2001 | Huang |
| 6,183,086 | B1 | 2/2001 | Neubert |
| 6,183,104 | B1 | 2/2001 | Ferrara |
| 6,184,628 | B1 | 2/2001 | Ruthenberg |
| 6,196,471 | B1 | 3/2001 | Ruthenberg |
| 6,203,180 | B1 | 3/2001 | Fleischmann |
| 6,211,626 | B1 | 4/2001 | Lys et al. |
| 6,215,409 | B1 | 4/2001 | Blach |
| 6,217,190 | B1 | 4/2001 | Altman et al. |
| 6,219,239 | B1 | 4/2001 | Mellberg et al. |
| 6,220,722 | B1 | 4/2001 | Begemann |
| 6,227,679 | B1 | 5/2001 | Zhang et al. |
| 6,236,331 | B1 | 5/2001 | Dussureault |
| 6,238,075 | B1 | 5/2001 | Dealey, Jr. et al. |
| 6,241,359 | B1 | 6/2001 | Lin |
| 6,249,221 | B1 | 6/2001 | Reed |
| 6,250,774 | B1 | 6/2001 | Begemann et al. |
| 6,252,350 | B1 | 6/2001 | Alvarez |
| 6,252,358 | B1 | 6/2001 | Xydis et al. |
| 6,268,600 | B1 | 7/2001 | Nakamura et al. |
| 6,273,338 | B1 | 8/2001 | White |
| 6,275,397 | B1 | 8/2001 | McClain |
| 6,283,612 | B1 | 9/2001 | Hunter |
| 6,290,140 | B1 | 9/2001 | Pesko et al. |
| 6,292,901 | B1 | 9/2001 | Lys et al. |
| 6,293,684 | B1 | 9/2001 | Riblett |
| 6,297,724 | B1 | 10/2001 | Bryans et al. |
| 6,305,109 | B1 | 10/2001 | Lee |
| 6,305,821 | B1 | 10/2001 | Hsieh et al. |
| 6,307,331 | B1 | 10/2001 | Bonasia et al. |
| 6,310,590 | B1 | 10/2001 | Havel |
| 6,315,429 | B1 | 11/2001 | Grandolfo |
| 6,323,832 | B1 | 11/2001 | Nishizawa et al. |
| 6,325,651 | B1 | 12/2001 | Nishihara et al. |
| 6,334,699 | B1 | 1/2002 | Gladnick |
| 6,340,868 | B1 | 1/2002 | Lys et al. |
| 6,354,714 | B1 | 3/2002 | Rhodes |
| 6,361,186 | B1 | 3/2002 | Slayden |
| 6,362,578 | B1 | 3/2002 | Swanson et al. |
| 6,369,525 | B1 | 4/2002 | Chang et al. |
| 6,371,637 | B1 | 4/2002 | Atchinson et al. |
| 6,373,733 | B1 | 4/2002 | Wu et al. |
| 6,379,022 | B1 | 4/2002 | Amerson et al. |
| D457,667 | S | 5/2002 | Piepgras et al. |
| D457,669 | S | 5/2002 | Piepgras et al. |
| D457,974 | S | 5/2002 | Piepgras et al. |
| 6,388,393 | B1 | 5/2002 | Illingworth |
| 6,388,396 | B1 | 5/2002 | Katyl et al. |
| 6,394,623 | B1 | 5/2002 | Tsui |
| 6,396,216 | B1 | 5/2002 | Noone et al. |
| D458,395 | S | 6/2002 | Piepgras et al. |
| 6,400,096 | B1 | 6/2002 | Wells et al. |
| 6,404,131 | B1 | 6/2002 | Kawano et al. |
| 6,411,022 | B1 | 6/2002 | Machida |
| 6,411,045 | B1 | 6/2002 | Nerone |
| 6,422,716 | B2 | 7/2002 | Henrici et al. |
| 6,428,189 | B1 | 8/2002 | Hochstein |
| 6,429,604 | B1 | 8/2002 | Chang |
| D463,610 | S | 9/2002 | Piepgras et al. |
| 6,445,139 | B1 | 9/2002 | Marshall et al. |
| 6,448,550 | B1 | 9/2002 | Nishimura |
| 6,448,716 | B1 | 9/2002 | Hutchison |
| 6,459,919 | B1 | 10/2002 | Lys et al. |
| 6,464,373 | B1 | 10/2002 | Petrick |
| 6,469,457 | B2 | 10/2002 | Callahan |
| 6,471,388 | B1 | 10/2002 | Marsh |
| 6,472,823 | B2 | 10/2002 | Yen |
| 6,473,002 | B1 | 10/2002 | Hutchison |
| D468,035 | S | 12/2002 | Bianc et al. |
| 6,488,392 | B1 | 12/2002 | Lu |
| 6,495,964 | B1 | 12/2002 | Muthu et al. |
| 6,511,204 | B2 | 1/2003 | Emmel et al. |
| 6,517,218 | B2 | 2/2003 | Hochstein |
| 6,521,879 | B1 | 2/2003 | Rand et al. |
| 6,522,078 | B1 | 2/2003 | Okamoto et al. |
| 6,527,411 | B1 | 3/2003 | Sayers |
| 6,528,954 | B1 | 3/2003 | Lys et al. |
| 6,528,958 | B2 | 3/2003 | Hulshof et al. |

(56) References Cited

U.S. PATENT DOCUMENTS

| | | | |
|---|---|---|---|
| 6,538,375 | B1 | 3/2003 | Duggal et al. |
| 6,540,381 | B1 | 4/2003 | Douglass, II |
| 6,541,800 | B2 | 4/2003 | Barnett et al. |
| 6,548,967 | B1 | 4/2003 | Dowling et al. |
| 6,568,834 | B1 | 5/2003 | Scianna |
| 6,573,536 | B1 | 6/2003 | Dry |
| 6,577,072 | B2 | 6/2003 | Saito et al. |
| 6,577,080 | B2 | 6/2003 | Lys et al. |
| 6,577,512 | B2 | 6/2003 | Tripathi et al. |
| 6,577,794 | B1 | 6/2003 | Currie et al. |
| 6,578,979 | B2 | 6/2003 | Truttmann-Battig |
| 6,582,103 | B1 | 6/2003 | Popovich et al. |
| 6,583,550 | B2 | 6/2003 | Iwasa et al. |
| 6,583,573 | B2 | 6/2003 | Bierman |
| D477,093 | S | 7/2003 | Moriyama et al. |
| 6,585,393 | B1 | 7/2003 | Brandes et al. |
| 6,586,890 | B2 | 7/2003 | Min et al. |
| 6,587,049 | B1 | 7/2003 | Thacker |
| 6,590,343 | B2 | 7/2003 | Pederson |
| 6,592,238 | B2 | 7/2003 | Cleaver et al. |
| 6,594,369 | B1 | 7/2003 | Une |
| 6,596,977 | B2 | 7/2003 | Muthu et al. |
| 6,598,996 | B1 | 7/2003 | Lodhie |
| 6,608,453 | B2 | 8/2003 | Morgan et al. |
| 6,608,614 | B1 | 8/2003 | Johnson |
| 6,609,804 | B2 | 8/2003 | Nolan et al. |
| 6,609,813 | B1 | 8/2003 | Showers et al. |
| 6,612,712 | B2 | 9/2003 | Nepil |
| 6,612,717 | B2 | 9/2003 | Yen |
| 6,612,729 | B1 | 9/2003 | Hoffman |
| 6,621,222 | B1 | 9/2003 | Hong |
| 6,623,151 | B2 | 9/2003 | Pederson |
| 6,624,597 | B2 | 9/2003 | Dowling et al. |
| D481,484 | S | 10/2003 | Cuevas et al. |
| 6,634,770 | B2 | 10/2003 | Cao |
| 6,634,779 | B2 | 10/2003 | Reed |
| 6,636,003 | B2 | 10/2003 | Rahm et al. |
| 6,639,349 | B1 | 10/2003 | Bahadur |
| 6,641,284 | B2 | 11/2003 | Stopa et al. |
| 6,652,117 | B2 | 11/2003 | Tsai |
| 6,659,622 | B2 | 12/2003 | Katogi et al. |
| 6,660,935 | B2 | 12/2003 | Southard et al. |
| 6,666,689 | B1 | 12/2003 | Savage, Jr. |
| 6,667,623 | B2 | 12/2003 | Bourgault et al. |
| 6,674,096 | B2 | 1/2004 | Sommers |
| 6,676,284 | B1 | 1/2004 | Wynne Willson |
| 6,679,621 | B2 | 1/2004 | West et al. |
| 6,681,154 | B2 | 1/2004 | Nierlich et al. |
| 6,682,205 | B2 | 1/2004 | Lin |
| 6,683,419 | B2 | 1/2004 | Kriparos |
| 6,700,136 | B2 | 3/2004 | Guida |
| 6,712,486 | B1 | 3/2004 | Popovich et al. |
| 6,717,376 | B2 | 4/2004 | Lys et al. |
| 6,717,526 | B2 | 4/2004 | Martineau et al. |
| 6,720,745 | B2 | 4/2004 | Lys et al. |
| 6,726,348 | B2 | 4/2004 | Gloisten |
| 6,736,328 | B1 | 5/2004 | Takusagawa |
| 6,736,525 | B2 | 5/2004 | Chin |
| 6,741,324 | B1 | 5/2004 | Kim |
| D491,678 | S | 6/2004 | Piepgras |
| D492,042 | S | 6/2004 | Piepgras |
| 6,744,223 | B2 | 6/2004 | Laflamme et al. |
| 6,748,299 | B1 | 6/2004 | Motoyama |
| 6,762,562 | B2 | 7/2004 | Leong |
| 6,768,047 | B2 | 7/2004 | Chang et al. |
| 6,774,584 | B2 | 8/2004 | Lys et al. |
| 6,777,891 | B2 | 8/2004 | Lys et al. |
| 6,781,329 | B2 | 8/2004 | Mueller et al. |
| 6,787,999 | B2 | 9/2004 | Stimac et al. |
| 6,788,000 | B2 | 9/2004 | Appelberg et al. |
| 6,788,011 | B2 | 9/2004 | Mueller et al. |
| 6,791,840 | B2 | 9/2004 | Chun |
| 6,796,680 | B1 | 9/2004 | Showers et al. |
| 6,799,864 | B2 | 10/2004 | Bohler et al. |
| 6,801,003 | B2 | 10/2004 | Schanberger et al. |
| 6,803,732 | B2 | 10/2004 | Kraus et al. |
| 6,806,659 | B1 | 10/2004 | Mueller et al. |
| 6,812,970 | B1 | 11/2004 | McBride |
| 6,814,470 | B2 | 11/2004 | Rizkin et al. |
| 6,814,478 | B2 | 11/2004 | Menke |
| 6,815,724 | B2 | 11/2004 | Dry |
| 6,846,094 | B2 | 1/2005 | Luk |
| 6,851,816 | B2 | 2/2005 | Wu et al. |
| 6,851,832 | B2 | 2/2005 | Tieszen |
| 6,853,150 | B2 | 2/2005 | Clauberg et al. |
| 6,853,151 | B2 | 2/2005 | Leong et al. |
| 6,853,563 | B1 | 2/2005 | Yang et al. |
| 6,857,924 | B2 | 2/2005 | Fu et al. |
| 6,860,628 | B2 | 3/2005 | Robertson et al. |
| 6,866,401 | B2 | 3/2005 | Sommers et al. |
| 6,869,204 | B2 | 3/2005 | Morgan et al. |
| 6,871,981 | B2 | 3/2005 | Alexanderson et al. |
| 6,874,924 | B1 | 4/2005 | Hulse et al. |
| 6,879,883 | B1 | 4/2005 | Motoyama |
| 6,882,111 | B2 | 4/2005 | Kan et al. |
| 6,883,929 | B2 | 4/2005 | Dowling |
| 6,883,934 | B2 | 4/2005 | Kawakami et al. |
| 6,888,322 | B2 | 5/2005 | Dowling et al. |
| 6,897,624 | B2 | 5/2005 | Lys et al. |
| D506,274 | S | 6/2005 | Moriyama et al. |
| 6,909,239 | B2 | 6/2005 | Gauna |
| 6,909,921 | B1 | 6/2005 | Bilger |
| 6,918,680 | B2 | 7/2005 | Seeberger |
| 6,921,181 | B2 | 7/2005 | Yen |
| 6,926,419 | B2 | 8/2005 | An |
| 6,936,968 | B2 | 8/2005 | Cross et al. |
| 6,936,978 | B2 | 8/2005 | Morgan et al. |
| 6,940,230 | B2 | 9/2005 | Myron et al. |
| 6,948,829 | B2 | 9/2005 | Verdes et al. |
| 6,953,261 | B1 | 10/2005 | Jiao et al. |
| 6,957,905 | B1 | 10/2005 | Pritchard et al. |
| 6,963,175 | B2 | 11/2005 | Archenhold et al. |
| 6,964,501 | B2 | 11/2005 | Ryan |
| 6,965,197 | B2 | 11/2005 | Tyan et al. |
| 6,965,205 | B2 | 11/2005 | Piepgras et al. |
| 6,967,448 | B2 | 11/2005 | Morgan et al. |
| 6,969,179 | B2 | 11/2005 | Sloan et al. |
| 6,969,186 | B2 | 11/2005 | Sonderegger et al. |
| 6,969,954 | B2 | 11/2005 | Lys |
| 6,975,079 | B2 | 12/2005 | Lys et al. |
| 6,979,097 | B2 | 12/2005 | Elam et al. |
| 6,982,518 | B2 | 1/2006 | Chou et al. |
| 6,995,681 | B2 | 2/2006 | Pederson |
| 6,997,576 | B1 | 2/2006 | Lodhie et al. |
| 6,999,318 | B2 | 2/2006 | Newby |
| 7,004,603 | B2 | 2/2006 | Knight |
| D518,218 | S | 3/2006 | Roberge et al. |
| 7,008,079 | B2 | 3/2006 | Smith |
| 7,014,336 | B1 | 3/2006 | Ducharme et al. |
| 7,015,650 | B2 | 3/2006 | McGrath |
| 7,018,063 | B2 | 3/2006 | Michael et al. |
| 7,018,074 | B2 | 3/2006 | Raby et al. |
| 7,021,799 | B2 | 4/2006 | Mizuyoshi |
| 7,021,809 | B2 | 4/2006 | Iwasa et al. |
| 7,024,256 | B2 | 4/2006 | Krzyzanowski et al. |
| 7,029,145 | B2 | 4/2006 | Frederick |
| 7,031,920 | B2 | 4/2006 | Dowling et al. |
| 7,033,036 | B2 | 4/2006 | Pederson |
| 7,038,398 | B1 | 5/2006 | Lys et al. |
| 7,038,399 | B2 | 5/2006 | Lys et al. |
| 7,042,172 | B2 | 5/2006 | Dowling et al. |
| 7,048,423 | B2 | 5/2006 | Stepanenko et al. |
| 7,049,761 | B2 | 5/2006 | Timmermans et al. |
| 7,052,171 | B1 | 5/2006 | Lefebvre et al. |
| 7,053,557 | B2 | 5/2006 | Cross et al. |
| 7,064,498 | B2 | 6/2006 | Dowling et al. |
| 7,064,674 | B2 | 6/2006 | Pederson |
| 7,067,992 | B2 | 6/2006 | Leong et al. |
| 7,077,978 | B2 | 7/2006 | Setlur et al. |
| 7,080,927 | B2 | 7/2006 | Feuerborn et al. |
| 7,086,747 | B2 | 8/2006 | Nielson et al. |
| 7,088,014 | B2 | 8/2006 | Nierlich et al. |
| 7,088,904 | B2 | 8/2006 | Ryan, Jr. |
| 7,102,902 | B1 | 9/2006 | Brown et al. |

(56) References Cited

U.S. PATENT DOCUMENTS

| | | | |
|---|---|---|---|
| 7,113,541 | B1 | 9/2006 | Lys et al. |
| 7,114,830 | B2 | 10/2006 | Robertson et al. |
| 7,114,834 | B2 | 10/2006 | Rivas et al. |
| 7,118,262 | B2 | 10/2006 | Negley |
| 7,119,503 | B2 | 10/2006 | Kemper |
| 7,120,560 | B2 | 10/2006 | Williams et al. |
| 7,121,679 | B2 | 10/2006 | Fujimoto |
| 7,122,976 | B1 | 10/2006 | Null et al. |
| 7,123,139 | B2 | 10/2006 | Sweeney |
| 7,128,442 | B2 | 10/2006 | Lee et al. |
| 7,128,454 | B2 | 10/2006 | Kim et al. |
| D532,532 | S | 11/2006 | Maxik |
| 7,132,635 | B2 | 11/2006 | Dowling |
| 7,132,785 | B2 | 11/2006 | Ducharme |
| 7,132,804 | B2 | 11/2006 | Lys et al. |
| 7,135,824 | B2 | 11/2006 | Lys et al. |
| 7,139,617 | B1 | 11/2006 | Morgan et al. |
| 7,144,135 | B2 | 12/2006 | Martin et al. |
| 7,153,002 | B2 | 12/2006 | Kim et al. |
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,164,110 | B2 | 1/2007 | Pitigoi-Aron et al. |
| 7,164,235 | B2 | 1/2007 | Ito et al. |
| 7,165,863 | B1 | 1/2007 | Thomas et al. |
| 7,165,866 | B2 | 1/2007 | Li |
| 7,167,777 | B2 | 1/2007 | Budike, Jr. |
| 7,168,843 | B2 | 1/2007 | Striebel |
| D536,468 | S | 2/2007 | Crosby |
| 7,178,941 | B2 | 2/2007 | Roberge et al. |
| 7,180,252 | B2 | 2/2007 | Lys et al. |
| D538,950 | S | 3/2007 | Maxik |
| D538,952 | S | 3/2007 | Maxik et al. |
| D538,962 | S | 3/2007 | Elliot |
| 7,186,003 | B2 | 3/2007 | Dowling et al. |
| 7,186,005 | B2 | 3/2007 | Hulse |
| 7,187,141 | B2 | 3/2007 | Mueller et al. |
| 7,190,126 | B1 | 3/2007 | Paton |
| 7,192,154 | B2 | 3/2007 | Becker |
| 7,198,387 | B1 | 4/2007 | Gloisten et al. |
| 7,201,491 | B2 | 4/2007 | Bayat et al. |
| 7,201,497 | B2 | 4/2007 | Weaver, Jr. et al. |
| 7,202,613 | B2 | 4/2007 | Morgan et al. |
| 7,204,615 | B2 | 4/2007 | Arik et al. |
| 7,204,622 | B2 | 4/2007 | Dowling et al. |
| 7,207,696 | B1 | 4/2007 | Lin |
| 7,210,818 | B2 | 5/2007 | Luk et al. |
| 7,210,957 | B2 | 5/2007 | Mrakovich et al. |
| 7,211,959 | B1 | 5/2007 | Chou |
| 7,213,934 | B2 | 5/2007 | Zarian et al. |
| 7,217,004 | B2 | 5/2007 | Park et al. |
| 7,217,012 | B2 | 5/2007 | Southard et al. |
| 7,217,022 | B2 | 5/2007 | Ruffin |
| 7,218,056 | B1 | 5/2007 | Harwood |
| 7,218,238 | B2 | 5/2007 | Right et al. |
| 7,220,015 | B2 | 5/2007 | Dowling |
| 7,220,018 | B2 | 5/2007 | Crabb et al. |
| 7,221,104 | B2 | 5/2007 | Lys et al. |
| 7,221,110 | B2 | 5/2007 | Sears et al. |
| 7,224,000 | B2 | 5/2007 | Aanegoia et al. |
| 7,226,189 | B2 | 6/2007 | Lee et al. |
| 7,228,052 | B1 | 6/2007 | Lin |
| 7,228,190 | B2 | 6/2007 | Dowling et al. |
| 7,231,060 | B2 | 6/2007 | Dowling et al. |
| 7,233,115 | B2 | 6/2007 | Lys et al. |
| 7,233,831 | B2 | 6/2007 | Blackwell |
| 7,236,366 | B2 | 6/2007 | Chen |
| 7,237,924 | B2 | 7/2007 | Martineau et al. |
| 7,237,925 | B2 | 7/2007 | Mayer et al. |
| 7,239,532 | B1 | 7/2007 | Hsu et al. |
| 7,241,038 | B2 | 7/2007 | Naniwa et al. |
| 7,242,152 | B2 | 7/2007 | Dowling et al. |
| 7,244,058 | B2 | 7/2007 | DiPenti et al. |
| 7,246,926 | B2 | 7/2007 | Harwood |
| 7,246,931 | B2 | 7/2007 | Hsieh et al. |
| 7,248,239 | B2 | 7/2007 | Dowling et al. |
| 7,249,269 | B1 | 7/2007 | Motoyama |
| 7,249,865 | B2 | 7/2007 | Robertson |
| D548,868 | S | 8/2007 | Roberge et al. |
| 7,248,467 | B2 | 8/2007 | Saccomanno et al. |
| 7,252,408 | B2 | 8/2007 | Mazzochette et al. |
| 7,253,566 | B2 | 8/2007 | Lys et al. |
| 7,255,457 | B2 | 8/2007 | Ducharme et al. |
| 7,255,460 | B2 | 8/2007 | Lee |
| 7,256,554 | B2 | 8/2007 | Lys |
| 7,258,458 | B2 | 8/2007 | Mochiachvili et al. |
| 7,258,467 | B2 | 8/2007 | Saccomanno et al. |
| 7,259,528 | B2 | 8/2007 | Pilz |
| 7,262,439 | B2 | 8/2007 | Setlur et al. |
| 7,262,559 | B2 | 8/2007 | Tripathi et al. |
| D550,379 | S | 9/2007 | Hoshikawa et al. |
| 7,264,372 | B2 | 9/2007 | Maglica |
| 7,267,461 | B2 | 9/2007 | Kan |
| 7,267,467 | B2 | 9/2007 | Wu et al. |
| 7,270,443 | B2 | 9/2007 | Kurtz et al. |
| 7,271,794 | B1 | 9/2007 | Cheng et al. |
| 7,273,300 | B2 | 9/2007 | Mrakovich |
| 7,274,045 | B2 | 9/2007 | Chandran et al. |
| 7,274,160 | B2 | 9/2007 | Mueller et al. |
| 7,274,183 | B1 | 9/2007 | Gu et al. |
| D553,267 | S | 10/2007 | Yuen |
| 7,285,801 | B2 | 10/2007 | Eliashevich et al. |
| 7,288,902 | B1 | 10/2007 | Melanson |
| 7,288,904 | B2 | 10/2007 | Numeroli et al. |
| 7,296,912 | B2 | 11/2007 | Ichikawa et al. |
| 7,300,184 | B2 | 11/2007 | Ichikawa et al. |
| 7,300,192 | B2 | 11/2007 | Mueller et al. |
| D556,937 | S | 12/2007 | Ly |
| D557,854 | S | 12/2007 | Lewis |
| 7,303,300 | B2 | 12/2007 | Dowling et al. |
| 7,306,353 | B2 | 12/2007 | Popovich et al. |
| 7,307,391 | B2 | 12/2007 | Shan |
| 7,308,296 | B2 | 12/2007 | Lys et al. |
| 7,309,965 | B2 | 12/2007 | Dowling et al. |
| 7,318,658 | B2 | 1/2008 | Wang et al. |
| 7,319,244 | B2 | 1/2008 | Liu et al. |
| 7,319,246 | B2 | 1/2008 | Soules et al. |
| 7,321,191 | B2 | 1/2008 | Setlur et al. |
| 7,326,964 | B2 | 2/2008 | Lim et al. |
| 7,327,281 | B2 | 2/2008 | Hutchison |
| 7,329,024 | B2 | 2/2008 | Lynch et al. |
| 7,329,031 | B2 | 2/2008 | Liaw et al. |
| D563,589 | S | 3/2008 | Hariri et al. |
| 7,344,278 | B2 | 3/2008 | Paravantsos |
| 7,345,320 | B2 | 3/2008 | Dahm |
| 7,348,604 | B2 | 3/2008 | Matheson |
| 7,350,936 | B2 | 4/2008 | Ducharme et al. |
| 7,350,952 | B2 | 4/2008 | Nishigaki |
| 7,352,138 | B2 | 4/2008 | Lys et al. |
| 7,352,339 | B2 | 4/2008 | Morgan et al. |
| 7,353,071 | B2 | 4/2008 | Blackwell |
| 7,358,679 | B2 | 4/2008 | Lys et al. |
| 7,358,929 | B2 | 4/2008 | Mueller |
| 7,370,986 | B2 | 5/2008 | Chan |
| 7,374,327 | B2 | 5/2008 | Schexnaider |
| 7,378,805 | B2 | 5/2008 | Oh et al. |
| 7,378,976 | B1 | 5/2008 | Paterno |
| 7,385,359 | B2 | 6/2008 | Dowling et al. |
| 7,391,159 | B2 | 6/2008 | Harwood |
| D574,093 | S | 7/2008 | Kitagawa et al. |
| 7,396,142 | B2 | 7/2008 | Laizure, Jr. et al. |
| 7,396,146 | B2 | 7/2008 | Wang |
| 7,401,935 | B2 | 7/2008 | VanderSchult |
| 7,401,945 | B2 | 7/2008 | Zhang |
| D576,749 | S | 9/2008 | Kitagawa et al. |
| 7,423,548 | B2 | 9/2008 | Kontovich |
| 7,427,840 | B2 | 9/2008 | Morgan et al. |
| 7,429,117 | B2 | 9/2008 | Pohlert et al. |
| 7,434,964 | B1 | 10/2008 | Zheng et al. |
| 7,438,441 | B2 | 10/2008 | Sun et al. |
| D580,089 | S | 11/2008 | Ly et al. |
| D581,556 | S | 11/2008 | To et al. |
| 7,449,847 | B2 | 11/2008 | Schanberger et al. |
| D582,577 | S | 12/2008 | Yuen |

(56) References Cited

U.S. PATENT DOCUMENTS

| | | | |
|---|---|---|---|
| 7,466,082 | B1 | 12/2008 | Snyeder et al. |
| 7,470,046 | B2 | 12/2008 | Kao et al. |
| D584,428 | S | 1/2009 | Li et al. |
| D584,429 | S | 1/2009 | Pei et al. |
| 7,476,002 | B2 | 1/2009 | Wolf et al. |
| 7,476,004 | B2 | 1/2009 | Chan |
| 7,478,924 | B2 | 1/2009 | Robertson |
| 7,482,764 | B2 | 1/2009 | Morgan et al. |
| D586,484 | S | 2/2009 | Liu et al. |
| D586,928 | S | 2/2009 | Liu et al. |
| 7,490,957 | B2 | 2/2009 | Leong et al. |
| 7,494,246 | B2 | 2/2009 | Harbers et al. |
| 7,497,596 | B2 | 3/2009 | Ge |
| 7,498,753 | B2 | 3/2009 | McAvoy et al. |
| 7,507,001 | B2 | 3/2009 | Kit |
| 7,510,299 | B2 | 3/2009 | Timmermans et al. |
| 7,510,400 | B2 | 3/2009 | Giovatsky et al. |
| 7,511,613 | B2 | 3/2009 | Wang |
| 7,514,876 | B2 | 4/2009 | Roach, Jr. |
| 7,520,635 | B2 | 4/2009 | Wolf et al. |
| 7,521,872 | B2 | 4/2009 | Bruning |
| 7,524,089 | B2 | 4/2009 | Park |
| D592,766 | S | 5/2009 | Zhu et al. |
| D593,223 | S | 5/2009 | Komar |
| 7,530,701 | B2 | 5/2009 | Chan-Wing |
| 7,534,002 | B2 | 5/2009 | Yamaguchi et al. |
| D594,999 | S | 6/2009 | Uchida et al. |
| 7,549,769 | B2 | 6/2009 | Kim et al. |
| 7,556,396 | B2 | 7/2009 | Kuo et al. |
| 7,559,663 | B2 | 7/2009 | Wong et al. |
| 7,562,998 | B1 | 7/2009 | Yen |
| D597,686 | S | 8/2009 | Noh |
| 7,569,981 | B1 | 8/2009 | Ciancanelli |
| 7,572,027 | B2 | 8/2009 | Zampini |
| 7,572,030 | B2 | 8/2009 | Booth et al. |
| 7,575,339 | B2 | 8/2009 | Hung |
| 7,579,786 | B2 | 8/2009 | Soos |
| 7,582,911 | B2 | 9/2009 | Lynch |
| 7,583,035 | B2 | 9/2009 | Shteynberg et al. |
| 7,583,901 | B2 | 9/2009 | Nakagawa et al. |
| 7,592,757 | B2 | 9/2009 | Hargenrader et al. |
| 7,594,738 | B1 | 9/2009 | Lin et al. |
| D601,726 | S | 10/2009 | Mollaert et al. |
| 7,598,681 | B2 | 10/2009 | Lys et al. |
| 7,598,684 | B2 | 10/2009 | Lys et al. |
| 7,600,907 | B2 | 10/2009 | Liu et al. |
| 7,602,559 | B2 | 10/2009 | Jang et al. |
| 7,616,849 | B1 | 11/2009 | Simon |
| 7,618,157 | B1 | 11/2009 | Galvez et al. |
| 7,619,366 | B2 | 11/2009 | Diederiks |
| 7,635,201 | B2 | 12/2009 | Deng |
| 7,635,214 | B2 | 12/2009 | Perio |
| 7,639,517 | B2 | 12/2009 | Zhou et al. |
| 7,648,251 | B2 | 1/2010 | Whitehouse et al. |
| 7,649,327 | B2 | 1/2010 | Peng |
| D610,724 | S | 2/2010 | Chiang et al. |
| 7,654,703 | B2 | 2/2010 | Kan et al. |
| 7,661,839 | B2 | 2/2010 | Tsai |
| D611,172 | S | 3/2010 | Lin et al. |
| D612,528 | S | 3/2010 | McGrath et al. |
| 7,690,813 | B2 | 4/2010 | Kanamori et al. |
| 7,710,047 | B2 | 5/2010 | Fredricks |
| 7,710,253 | B1 | 5/2010 | Fredricks |
| 7,712,918 | B2 | 5/2010 | Siemiet et al. |
| 7,748,886 | B2 | 7/2010 | Pazula et al. |
| 7,758,207 | B1 | 7/2010 | Zhou et al. |
| 7,759,881 | B1 | 7/2010 | Melanson |
| D621,975 | S | 8/2010 | Wang |
| 7,784,966 | B2 | 8/2010 | Verfuerth et al. |
| 7,800,511 | B1 | 9/2010 | Hutchison et al. |
| 7,815,338 | B2 | 10/2010 | Siemiet et al. |
| 7,815,341 | B2 | 10/2010 | Steedly et al. |
| 7,828,471 | B2 | 11/2010 | Lin |
| 7,843,150 | B2 | 11/2010 | Wang et al. |
| 7,848,702 | B2 | 12/2010 | Ho et al. |
| 7,850,341 | B2 | 12/2010 | Mrakovich et al. |
| 7,855,641 | B1 | 12/2010 | Okafo |
| RE42,161 | E | 2/2011 | Hochstein |
| 7,878,683 | B2 | 2/2011 | Logan et al. |
| 7,887,216 | B2 | 2/2011 | Patrick |
| 7,887,226 | B2 | 2/2011 | Huang et al. |
| 7,889,051 | B1 | 2/2011 | Biling et al. |
| D634,452 | S | 3/2011 | De Visser |
| 7,904,209 | B2 | 3/2011 | Podgomy et al. |
| D636,504 | S | 4/2011 | Duster |
| 7,926,975 | B2 | 4/2011 | Siemiet et al. |
| 7,938,562 | B2 | 5/2011 | Ivey et al. |
| 7,946,729 | B2 | 5/2011 | Ivey et al. |
| 7,952,292 | B2 | 5/2011 | Vegter et al. |
| 7,976,185 | B2 | 7/2011 | Uang et al. |
| 7,976,196 | B2 | 7/2011 | Ivey et al. |
| 7,990,070 | B2 | 8/2011 | Nerone |
| 7,997,770 | B1 | 8/2011 | Meurer |
| 8,013,472 | B2 | 9/2011 | Adest et al. |
| D650,097 | S | 12/2011 | Trumble et al. |
| D650,494 | S | 12/2011 | Tsao et al. |
| D652,968 | S | 1/2012 | Aguiar et al. |
| 8,093,823 | B1 | 1/2012 | Ivey et al. |
| D654,192 | S | 2/2012 | Maxik et al. |
| 8,118,447 | B2 | 2/2012 | Simon et al. |
| 8,136,738 | B1 | 3/2012 | Kopp |
| 8,147,091 | B2 | 4/2012 | Hsia et al. |
| 8,159,152 | B1 | 4/2012 | Salessi |
| D660,472 | S | 5/2012 | Aguiar et al. |
| 8,167,452 | B2 | 5/2012 | Chou |
| 8,177,388 | B2 | 5/2012 | Yen |
| 8,179,037 | B2 | 5/2012 | Chan et al. |
| 8,183,989 | B2 | 5/2012 | Tsai |
| D662,236 | S | 6/2012 | Matsushita |
| 8,203,445 | B2 | 6/2012 | Recker et al. |
| 8,214,084 | B2 | 7/2012 | Ivey et al. |
| 8,230,690 | B1 | 7/2012 | Salessi |
| 8,247,985 | B2 | 8/2012 | Timmermans et al. |
| 8,251,544 | B2 | 8/2012 | Ivey et al. |
| 8,262,249 | B2 | 9/2012 | Hsia et al. |
| 8,272,764 | B2 | 9/2012 | Son |
| 8,287,144 | B2 | 10/2012 | Pederson et al. |
| 8,297,788 | B2 | 10/2012 | Bishop |
| 8,299,722 | B2 | 10/2012 | Melanson |
| 8,304,993 | B2 | 11/2012 | Tzou et al. |
| 8,305,225 | B2 | 11/2012 | Hefright |
| 8,313,213 | B2 | 11/2012 | Lin et al. |
| 8,319,407 | B2 | 11/2012 | Ke |
| 8,319,433 | B2 | 11/2012 | Lin et al. |
| 8,319,437 | B2 | 11/2012 | Carlin et al. |
| 8,322,878 | B2 | 12/2012 | Hsia et al. |
| 8,324,817 | B2 | 12/2012 | Ivey et al. |
| 8,337,071 | B2 | 12/2012 | Negley et al. |
| 8,366,291 | B2 | 2/2013 | Hoffmann |
| 8,376,579 | B2 | 2/2013 | Chang |
| 8,376,588 | B2 | 2/2013 | Yen |
| 8,382,322 | B2 | 2/2013 | Bishop |
| 8,382,327 | B2 | 2/2013 | Timmermans et al. |
| 8,382,502 | B2 | 2/2013 | Cao et al. |
| 8,388,179 | B2 | 3/2013 | Hood et al. |
| 8,398,275 | B2 | 3/2013 | Wang et al. |
| 8,403,692 | B2 | 3/2013 | Cao et al. |
| 8,405,314 | B2 | 3/2013 | Jensen et al. |
| 8,408,734 | B2 * | 4/2013 | Wu ..... F21V 19/0055 362/218 |
| 8,434,914 | B2 | 5/2013 | Li et al. |
| 8,454,193 | B2 | 6/2013 | Simon et al. |
| 8,496,351 | B2 | 7/2013 | Lo et al. |
| 8,523,394 | B2 | 9/2013 | Simon et al. |
| 8,531,109 | B2 | 9/2013 | Visser et al. |
| 8,540,401 | B2 | 9/2013 | Simon et al. |
| 8,571,716 | B2 | 10/2013 | Ivey et al. |
| 8,628,216 | B2 | 1/2014 | Ivey et al. |
| 8,653,984 | B2 | 2/2014 | Ivey et al. |
| 8,672,508 | B2 | 3/2014 | Pearson |
| 8,674,626 | B2 | 3/2014 | Siemiet et al. |
| 8,807,785 | B2 | 8/2014 | Vey et al. |
| 8,830,080 | B2 | 9/2014 | Vey et al. |
| 8,840,282 | B2 | 9/2014 | Simon et al. |

(56) References Cited

U.S. PATENT DOCUMENTS 8,870,412 B1 10/2014 Timmermans et al.
8,870,415 B2 10/2014 Vey
9,016,895 B2 4/2015 Handsaker
9,072,171 B2 6/2015 Simon
9,184,518 B2 11/2015 Vey et al.
10,161,568 B2 12/2018 Amrine, Jr. et al.
2001/0033488 A1 10/2001 Chliwnyj et al.
2001/0045803 A1 11/2001 Cencur
2002/0011801 A1 1/2002 Chang
2002/0015297 A1 2/2002 Hayashi et al.
2002/0038157 A1 3/2002 Dowling et al.
2002/0041159 A1 4/2002 Kaping, Jr.
2002/0044066 A1 4/2002 Dowling et al.
2002/0047516 A1 4/2002 Iwasa et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0074958 A1 6/2002 Crenshaw
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling et al.
2002/0152045 A1 10/2002 Dowling et al.
2002/0152298 A1 10/2002 Kilkrta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0175639 A1 11/2002 Pitigoi-Aron
2002/0176253 A1 11/2002 Ming
2002/0176259 A1 11/2002 Ducharme et al.
2002/0179816 A1 12/2002 Haines et al.
2002/0195975 A1 12/2002 Schanberger et al.
2003/0011538 A1 1/2003 Lys et al.
2003/0021117 A1 1/2003 Wen
2003/0028260 A1 2/2003 Blackwell
2003/0031015 A1 2/2003 Ishibashi
2003/0048641 A1 3/2003 Alexanderson et al.
2003/0052599 A1 3/2003 Sun
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0218879 A1 11/2003 Tieszen
2003/0222578 A1 12/2003 Cok
2003/0222587 A1 12/2003 Dowling et al.
2003/0234342 A1 12/2003 Gaines et al.
2004/0003545 A1 1/2004 Gillespie
2004/0007980 A1 1/2004 Shibata
2004/0012959 A1 1/2004 Jones et al.
2004/0036006 A1 2/2004 Dowling et al.
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0114371 A1 6/2004 Lea et al.
2004/0116039 A1 6/2004 Mueller et al.
2004/0124782 A1 7/2004 Yu
2004/0130908 A1 7/2004 McClurg et al.
2004/0130909 A1 7/2004 Mueller et al.
2004/0141321 A1 7/2004 Dowling et al.
2004/0145886 A1 7/2004 Fatemi et al.
2004/0155609 A1 8/2004 Lys et al.
2004/0160199 A1 8/2004 Morgan et al.
2004/0178751 A1 9/2004 Mueller et al.
2004/0189262 A1 9/2004 McGrath et al.
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0023536 A1 2/2005 Shackle
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme et al.
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0093488 A1 5/2005 Hung et al.
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0143173 A1 6/2005 Barney et al.
2005/0151489 A1 7/2005 Lys et al.
2005/0151663 A1 7/2005 Tanguay
2005/0154494 A1 7/2005 Ahmed
2005/0162093 A1 7/2005 Timmermans et al.
2005/0162100 A1 7/2005 Romano et al.
2005/0162101 A1 7/2005 Leong et al.
2005/0174473 A1 8/2005 Morgan et al.
2005/0174780 A1 8/2005 Park
2005/0184667 A1 8/2005 Sturman et al.
2005/0201112 A1 9/2005 Sturman et al.
2005/0206529 A1 9/2005 St. Germain
2005/0213320 A1 9/2005 Kazuhiro et al.
2005/0213352 A1 9/2005 Lys et al.
2005/0213353 A1 9/2005 Lys et al.
2005/0218838 A1 10/2005 Lys et al.
2005/0218870 A1 10/2005 Lys et al.
2005/0219860 A1 10/2005 Schexnaider
2005/0219872 A1 10/2005 Lys et al.
2005/0225979 A1 10/2005 Robertson et al.
2005/0231133 A1 10/2005 Lys et al.
2005/0236029 A1 10/2005 Dowling et al.
2005/0236998 A1 10/2005 Mueller et al.
2005/0242742 A1 11/2005 Cheang et al.
2005/0243577 A1 11/2005 Moon
2005/0248299 A1 11/2005 Chemel et al.
2005/0253533 A1 11/2005 Lys et al.
2005/0259424 A1 11/2005 Zampini et al.
2005/0264474 A1 12/2005 Rast
2005/0265019 A1 12/2005 Sommers
2005/0275626 A1 12/2005 Mueller et al.
2005/0276051 A1 12/2005 Caudle et al.
2005/0276053 A1 12/2005 Nortrup et al.

(56) References Cited

U.S. PATENT DOCUMENTS

2005/0276064 A1 12/2005 Wu et al.
2005/0281030 A1 12/2005 Leong et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0186214 A1 1/2006 Simon
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0044152 A1 3/2006 Wang
2006/0050509 A9 3/2006 Dowling et al.
2006/0050514 A1 3/2006 Opolka
2006/0056855 A1 3/2006 Nakagawa et al.
2006/0066447 A1 3/2006 Davenport et al.
2006/0076908 A1 4/2006 Morgan et al.
2006/0081863 A1 4/2006 Kim et al.
2006/0091826 A1 5/2006 Chen
2006/0092640 A1 5/2006 Li et al.
2006/0098077 A1 5/2006 Dowling et al.
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.
2006/0126338 A1 6/2006 Mighetto
2006/0132061 A1 6/2006 McCormick et al.
2006/0132323 A1 6/2006 Grady
2006/0146531 A1 7/2006 Reo et al.
2006/0152172 A9 7/2006 Mueller et al.
2006/0158881 A1 7/2006 Dowling et al.
2006/0170376 A1 8/2006 Piepgras et al.
2006/0192502 A1 8/2006 Brown et al.
2006/0193131 A1 8/2006 McGrath et al.
2006/0196953 A1 9/2006 Simon et al.
2006/0197661 A1 9/2006 Tracy et al.
2006/0198128 A1 9/2006 Piepgras et al.
2006/0208667 A1 9/2006 Lys et al.
2006/0215422 A1 9/2006 Laizure et al.
2006/0220595 A1 10/2006 Lu
2006/0221606 A1 10/2006 Dowling et al.
2006/0221619 A1 10/2006 Nishigaki
2006/0227558 A1 10/2006 Osawa et al.
2006/0232974 A1 10/2006 Lee et al.
2006/0238884 A1 10/2006 Jang et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0265921 A1 11/2006 Korall et al.
2006/0273741 A1 12/2006 Stalker
2006/0274529 A1 12/2006 Cao
2006/0285325 A1 12/2006 Ducharme et al.
2007/0035255 A1 2/2007 Shuster et al.
2007/0035538 A1 2/2007 Garcia et al.
2007/0035965 A1 2/2007 Holst
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0057805 A1 3/2007 Gomez
2007/0064419 A1 3/2007 Gandhi
2007/0064425 A1 3/2007 Frecska et al.
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1 5/2007 Wolf et al.
2007/0109782 A1 5/2007 Wolf et al.
2007/0115658 A1 5/2007 Mueller et al.
2007/0115665 A1 5/2007 Mueller et al.
2007/0120463 A1 5/2007 Hayashi et al.
2007/0120594 A1 5/2007 Balakrishnan et al.
2007/0127234 A1 6/2007 Jervey
2007/0133202 A1 6/2007 Huang et al.
2007/0139938 A1 6/2007 Petroski et al.
2007/0145915 A1 6/2007 Roberge et al.
2007/0146126 A1 6/2007 Wang
2007/0147046 A1 6/2007 Arik et al.
2007/0152797 A1 7/2007 Chemel et al.
2007/0152808 A1 7/2007 Lacasse
2007/0153514 A1 7/2007 Dowling et al.
2007/0159828 A1 7/2007 Wang
2007/0164677 A1 7/2007 Jeurissen
2007/0165402 A1 7/2007 Weaver, Jr. et al.
2007/0165405 A1 7/2007 Chen
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0200725 A1 8/2007 Fredericks et al.
2007/0205712 A1 9/2007 Radkov et al.
2007/0206375 A1 9/2007 Piepgras et al.
2007/0211461 A1 9/2007 Harwood
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0236358 A1 10/2007 Street et al.
2007/0237284 A1 10/2007 Lys et al.
2007/0240346 A1 10/2007 Li et al.
2007/0241657 A1 10/2007 Radkov et al.
2007/0242466 A1 10/2007 Wu
2007/0247450 A1 10/2007 Lee
2007/0247842 A1 10/2007 Zampini et al.
2007/0247847 A1 10/2007 Villard
2007/0247851 A1 10/2007 Villard
2007/0252161 A1 11/2007 Meis et al.
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0024067 A1 1/2008 Ishibashi
2008/0029720 A1 2/2008 Li
2008/0037226 A1 2/2008 Shin et al.
2008/0037245 A1 2/2008 Chan
2008/0037284 A1 2/2008 Rudisill
2008/0049434 A1 2/2008 Marsh
2008/0055894 A1 3/2008 Deng
2008/0062680 A1 3/2008 Timmermans et al.
2008/0068838 A1 3/2008 Galke et al.
2008/0068839 A1 3/2008 Matheson
2008/0074872 A1 3/2008 Panotopoulos
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094819 A1 4/2008 Vaish
2008/0094837 A1 4/2008 Dobbins et al.
2008/0129211 A1 6/2008 Lin et al.
2008/0130267 A1 6/2008 Dowling et al.

(56) References Cited

U.S. PATENT DOCUMENTS

2008/0150444 A1 6/2008 Usui et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0185961 A1 8/2008 Hong
2008/0186704 A1 8/2008 Chou et al.
2008/0192436 A1 8/2008 Peng et al.
2008/0198598 A1 8/2008 Ward
2008/0211386 A1 9/2008 Choi et al.
2008/0211419 A1 9/2008 Garrity
2008/0218993 A1 9/2008 Li
2008/0224629 A1 9/2008 Melanson
2008/0224636 A1 9/2008 Melanson
2008/0253125 A1 10/2008 Kang et al.
2008/0258631 A1 10/2008 Wu et al.
2008/0258647 A1 10/2008 Scianna
2008/0265799 A1 10/2008 Sibert
2008/0278092 A1 11/2008 Lys et al.
2008/0285257 A1 11/2008 King
2008/0285266 A1 11/2008 Thomas
2008/0290814 A1 11/2008 Leong et al.
2008/0291675 A1 11/2008 Lin et al.
2008/0298080 A1 12/2008 Wu et al.
2008/0304249 A1 12/2008 Davey et al.
2008/0310119 A1 12/2008 Giacoma
2008/0315773 A1 12/2008 Pang
2008/0315784 A1 12/2008 Tseng
2009/0002995 A1 1/2009 Lee et al.
2009/0010022 A1 1/2009 Tsai
2009/0016063 A1 1/2009 Hu
2009/0016068 A1 1/2009 Chang
2009/0018954 A1 1/2009 Roberts
2009/0021140 A1 1/2009 Takasu et al.
2009/0032604 A1 2/2009 Miller
2009/0033513 A1 2/2009 Salsbury et al.
2009/0046473 A1 2/2009 Tsai et al.
2009/0052186 A1 2/2009 Xue
2009/0059557 A1 3/2009 Tanaka
2009/0059559 A1 3/2009 Pabst et al.
2009/0059603 A1 3/2009 Recker et al.
2009/0065596 A1 3/2009 Seem et al.
2009/0067170 A1 3/2009 Bloemen et al.
2009/0067182 A1 3/2009 Hsu et al.
2009/0072945 A1 3/2009 Pan et al.
2009/0073693 A1 3/2009 Nall et al.
2009/0085500 A1 4/2009 Zampini, II et al.
2009/0086492 A1 4/2009 Meyer
2009/0091929 A1 4/2009 Faubion
2009/0091938 A1 4/2009 Jacobson et al.
2009/0101930 A1 4/2009 Li
2009/0115597 A1 5/2009 Giacalone
2009/0122571 A1 5/2009 Simmons et al.
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0231831 A1 9/2009 Hsiao et al.
2009/0268461 A1 10/2009 Deak et al.
2009/0273924 A1 11/2009 Chiang
2009/0273926 A1 11/2009 Deng
2009/0284169 A1 11/2009 Valois
2009/0290334 A1 11/2009 Ivey
2009/0295776 A1 12/2009 Yu et al.
2009/0296017 A1 12/2009 Itoh et al.
2009/0296381 A1 12/2009 Dubord
2009/0302730 A1 12/2009 Carroll et al.
2009/0303720 A1 12/2009 McGrath
2009/0316408 A1 12/2009 Villard
2010/0002426 A1 1/2010 Wu
2010/0002453 A1 1/2010 Wu et al.
2010/0008085 A1 1/2010 Ivey
2010/0019689 A1 1/2010 Shan
2010/0027259 A1 2/2010 Simon et al.
2010/0033095 A1 2/2010 Sadwick
2010/0033964 A1 2/2010 Choi et al.
2010/0046210 A1 2/2010 Mathai et al.
2010/0046222 A1 2/2010 Yang
2010/0061598 A1 3/2010 Seo
2010/0071946 A1 3/2010 Hashimoto
2010/0072904 A1 3/2010 Eckel et al.
2010/0073944 A1 3/2010 Chen
2010/0079085 A1 4/2010 Wendt et al.
2010/0096992 A1 4/2010 Yamamoto et al.
2010/0096998 A1 4/2010 Beers
2010/0103664 A1 4/2010 Simon et al.
2010/0103673 A1 4/2010 Ivey et al.
2010/0106306 A1 4/2010 Simon et al.
2010/0109550 A1 5/2010 Huda et al.
2010/0109558 A1 5/2010 Chew
2010/0141173 A1 6/2010 Negrete
2010/0148650 A1 6/2010 Wu et al.
2010/0149806 A1 6/2010 Yiu
2010/0157608 A1 6/2010 Chen et al.
2010/0164404 A1 7/2010 Shao et al.
2010/0177532 A1 7/2010 Simon et al.
2010/0181178 A1 7/2010 Chang et al.
2010/0201269 A1 8/2010 Tzou et al.
2010/0207547 A1 8/2010 Kuroki et al.
2010/0220469 A1 9/2010 Ivey et al.
2010/0237790 A1 9/2010 Peng
2010/0265732 A1 10/2010 Liu et al.
2010/0270925 A1 10/2010 Withers
2010/0277069 A1 11/2010 Janik et al.
2010/0289418 A1 11/2010 Langovsky
2010/0308733 A1 12/2010 Shao
2010/0309652 A1 12/2010 Shen et al.
2010/0320922 A1 12/2010 Palazzolo et al.
2010/0327766 A1 12/2010 Recker et al.
2011/0006658 A1 1/2011 Chan et al.
2011/0084608 A1 4/2011 Lin
2011/0090682 A1 4/2011 Zheng et al.
2011/0109454 A1 5/2011 McSheffrey et al.
2011/0112661 A1 5/2011 Jung et al.
2011/0140136 A1 6/2011 Daily et al.
2011/0141745 A1 6/2011 Gu et al.
2011/0149564 A1 6/2011 Hsia et al.
2011/0156584 A1 6/2011 Kim
2011/0176298 A1 7/2011 Meurer et al.
2011/0199723 A1 8/2011 Sato
2011/0199769 A1 8/2011 Bretschneider et al.
2011/0204777 A1 8/2011 Lenk
2011/0260647 A1 10/2011 Catalano et al.
2011/0280010 A1 11/2011 Ou et al.
2011/0291588 A1 12/2011 Tagare
2011/0310604 A1* 12/2011 Shimizu ..... F21V 15/015
362/235
2012/0008314 A1 1/2012 Simon et al.
2012/0008315 A1 1/2012 Simon et al.
2012/0014086 A1 1/2012 Jonsson
2012/0043892 A1 2/2012 Visser et al.
2012/0063140 A1 3/2012 Kong
2012/0080994 A1 4/2012 Hua-Chun et al.
2012/0081891 A1 4/2012 Tung et al.
2012/0081894 A1 4/2012 Simon et al.
2012/0098439 A1 4/2012 Recker et al.
2012/0106144 A1 5/2012 Chang
2012/0106153 A1 5/2012 Huang et al.
2012/0106157 A1 5/2012 Simon
2012/0113628 A1 5/2012 Burrow et al.
2012/0120660 A1 5/2012 Grauvogel
2012/0127726 A1 5/2012 Yen
2012/0139417 A1 6/2012 Mironichev et al.
2012/0146503 A1 6/2012 Negley et al.
2012/0146532 A1 6/2012 Vey et al.
2012/0147597 A1 6/2012 Farmer

(56) References Cited

U.S. PATENT DOCUMENTS

| | | | |
|---|---|---|---|
| 2012/0153865 | A1 | 6/2012 | Rolfes et al. |
| 2012/0153868 | A1 | 6/2012 | Rolfes et al. |
| 2012/0155073 | A1 | 6/2012 | McCanless et al. |
| 2012/0161666 | A1 | 6/2012 | Antony et al. |
| 2012/0194086 | A1 | 8/2012 | Liu et al. |
| 2012/0195032 | A1 | 8/2012 | Shew |
| 2012/0212951 | A1 | 8/2012 | Lai et al. |
| 2012/0212953 | A1 | 8/2012 | Bloom et al. |
| 2012/0230044 | A1 | 9/2012 | Zhang et al. |
| 2012/0236533 | A1 | 9/2012 | Nakamura et al. |
| 2012/0236554 | A1 | 9/2012 | Rust |
| 2012/0243216 | A1 | 9/2012 | Lai et al. |
| 2012/0243217 | A1 | 9/2012 | Szprengiel et al. |
| 2012/0250301 | A1 | 10/2012 | Tung |
| 2012/0274214 | A1 | 11/2012 | Radermacher et al. |
| 2012/0275154 | A1 | 11/2012 | Hood et al. |
| 2012/0293991 | A1 | 11/2012 | Lin |
| 2012/0293996 | A1 | 11/2012 | Thomas et al. |
| 2012/0300409 | A1 | 11/2012 | Lee |
| 2012/0300445 | A1 | 11/2012 | Chu et al. |
| 2012/0300468 | A1 | 11/2012 | Chang et al. |
| 2012/0300486 | A1 | 11/2012 | Matsushita et al. |
| 2012/0307524 | A1 | 12/2012 | Schapira et al. |
| 2012/0320598 | A1 | 12/2012 | Son |
| 2013/0010473 | A1 | 1/2013 | Dellian et al. |
| 2013/0033195 | A1 | 2/2013 | Liao |
| 2013/0038230 | A1 | 2/2013 | Brown et al. |
| 2013/0039051 | A1 | 2/2013 | Wu |
| 2013/0044471 | A1 | 2/2013 | Chen |
| 2013/0044476 | A1 | 2/2013 | Bretschneider et al. |
| 2013/0050997 | A1 | 2/2013 | Bretschneider et al. |
| 2013/0050998 | A1 | 2/2013 | Chu et al. |
| 2013/0057146 | A1 | 3/2013 | Chao |
| 2013/0058079 | A1 | 3/2013 | Dellian et al. |
| 2013/0063944 | A1 | 3/2013 | Lodhie et al. |
| 2013/0077296 | A1 | 3/2013 | Goeckel et al. |
| 2013/0077297 | A1 | 3/2013 | Wu et al. |
| 2013/0094200 | A1 | 4/2013 | Dellian et al. |
| 2013/0113393 | A1 | 5/2013 | Fujita et al. |
| 2013/0119896 | A1 | 5/2013 | Fukano |
| 2013/0147381 | A1 | 6/2013 | Yang |
| 2013/0148349 | A1 | 6/2013 | Pasqualini et al. |
| 2013/0200797 | A1 | 8/2013 | Timmermans et al. |
| 2013/0201690 | A1 | 8/2013 | Vissenberg et al. |
| 2013/0206597 | A1 | 8/2013 | Wang et al. |
| 2013/0221867 | A1 | 8/2013 | Deppe et al. |
| 2013/0230995 | A1 | 9/2013 | Vey et al. |
| 2013/0242553 | A1 | 9/2013 | Feng et al. |
| 2013/0250610 | A1 | 9/2013 | Brick et al. |
| 2013/0258668 | A1 | 10/2013 | Dellian et al. |
| 2013/0265746 | A1 | 10/2013 | May |
| 2014/0009068 | A1 | 1/2014 | Vey et al. |
| 2014/0009926 | A1 | 1/2014 | Simon et al. |
| 2014/0015345 | A1 | 1/2014 | Vey et al. |
| 2014/0036492 | A1 | 2/2014 | Simon et al. |
| 2014/0119001 | A1 | 5/2014 | Zhang |
| 2014/0126197 | A1 | 5/2014 | Dixon |
| 2014/0184082 | A1 | 7/2014 | Siemiet et al. |
| 2014/0268727 | A1 | 9/2014 | Amrine, Jr. et al. |
| 2014/0293595 | A1* | 10/2014 | May ..... F21V 3/0625 362/218 |
| 2014/0355262 | A1 | 12/2014 | Vey et al. |
| 2014/0368342 | A1 | 12/2014 | Vey et al. |
| 2015/0003070 | A1 | 1/2015 | Medendorp et al. |
| 2015/0009690 | A1 | 1/2015 | Simon et al. |
| 2015/0098228 | A1 | 4/2015 | Simon et al. |
| 2015/0204487 | A1 | 7/2015 | Scapa et al. |
| 2015/0334790 | A1 | 11/2015 | Scapa et al. |

FOREIGN PATENT DOCUMENTS

| | | |
|---|---|---|
| CN | 2869556 | 2/2007 |
| CN | 101016976 | 8/2007 |
| CN | 101075605 | 11/2007 |
| CN | 201129681 | 10/2008 |
| CN | 201184574 | 1/2009 |
| CN | 201373286 | 12/2009 |
| CN | 101737664 | 6/2010 |
| DE | 19651140 | 6/1997 |
| DE | 19624087 | 12/1997 |
| DE | 29819966 | 3/1999 |
| DE | 29817609 | 1/2000 |
| DE | 20018865 | 2/2001 |
| DE | 102004035027 | 2/2006 |
| EP | 0013782 | 3/1983 |
| EP | 0091172 | 10/1983 |
| EP | 0124924 | 9/1987 |
| EP | 0174699 | 11/1988 |
| EP | 0197602 | 11/1990 |
| EP | 0714556 | 1/1991 |
| EP | 0214701 | 3/1992 |
| EP | 0262713 | 6/1992 |
| EP | 0203668 | 2/1993 |
| EP | 0272749 | 8/1993 |
| EP | 0337567 | 11/1993 |
| EP | 0390262 | 12/1993 |
| EP | 0359329 | 3/1994 |
| EP | 0403011 | 4/1994 |
| EP | 0632511 | 1/1995 |
| EP | 0432848 | 4/1995 |
| EP | 0659531 | 6/1995 |
| EP | 0403001 | 8/1995 |
| EP | 0525876 | 5/1996 |
| EP | 0889283 | 7/1999 |
| EP | 0458408 | 9/1999 |
| EP | 0578302 | 9/1999 |
| EP | 0723701 | 1/2000 |
| EP | 1142452 | 3/2001 |
| EP | 0787419 | 5/2001 |
| EP | 1016062 | 8/2002 |
| EP | 1195740 | 1/2003 |
| EP | 1149510 | 2/2003 |
| EP | 1056993 | 3/2003 |
| EP | 0766436 | 5/2003 |
| EP | 0924281 | 5/2003 |
| EP | 0826167 | 6/2003 |
| EP | 1147686 | 1/2004 |
| EP | 1145602 | 3/2004 |
| EP | 1422975 | 5/2004 |
| EP | 0890059 | 6/2004 |
| EP | 1348319 | 6/2005 |
| EP | 1037862 | 7/2005 |
| EP | 1346609 | 8/2005 |
| EP | 1321012 | 12/2005 |
| EP | 1610593 | 12/2005 |
| EP | 1624728 | 2/2006 |
| EP | 1415517 | 5/2006 |
| EP | 1415518 | 5/2006 |
| EP | 1438877 | 5/2006 |
| EP | 1166604 | 6/2006 |
| EP | 1479270 | 7/2006 |
| EP | 1348318 | 8/2006 |
| EP | 1399694 | 8/2006 |
| EP | 1461980 | 10/2006 |
| EP | 1110120 | 4/2007 |
| EP | 1440604 | 4/2007 |
| EP | 1047903 | 6/2007 |
| EP | 1500307 | 6/2007 |
| EP | 0922305 | 8/2007 |
| EP | 0922306 | 8/2007 |
| EP | 1194918 | 8/2007 |
| EP | 1833035 | 9/2007 |
| EP | 1048085 | 11/2007 |
| EP | 1852648 | 11/2007 |
| EP | 1763650 | 12/2007 |
| EP | 1776722 | 1/2008 |
| EP | 1873012 | 1/2008 |
| EP | 1881261 | 1/2008 |
| EP | 1459599 | 2/2008 |
| EP | 1887836 | 2/2008 |
| EP | 1579733 | 4/2008 |
| EP | 1145282 | 7/2008 |
| EP | 1157428 | 9/2008 |

(56) References Cited

FOREIGN PATENT DOCUMENTS

| | | |
|---|---|---|
| EP | 1000522 | 12/2008 |
| EP | 1502483 | 12/2008 |
| EP | 1576858 | 12/2008 |
| EP | 1646092 | 1/2009 |
| EP | 1579736 | 2/2009 |
| EP | 1889519 | 3/2009 |
| EP | 1537354 | 4/2009 |
| EP | 1518445 | 5/2009 |
| EP | 1337784 | 6/2009 |
| EP | 2013530 | 8/2009 |
| EP | 1461982 | 9/2009 |
| EP | 2333407 | 6/2011 |
| EP | 2418422 | 2/2012 |
| EP | 2430888 | 3/2012 |
| EP | 2469155 | 6/2012 |
| EP | 2573457 | 3/2013 |
| EP | 2554895 | 6/2013 |
| EP | 2876354 | 5/2015 |
| FR | 2813115 | 2/2002 |
| GB | 2165977 | 4/1986 |
| GB | 2215024 | 9/1989 |
| GB | 2324901 | 11/1998 |
| GB | 2447257 | 9/2008 |
| GB | 2472345 | 2/2011 |
| GB | 2486410 | 6/2012 |
| GB | 2495647 | 4/2013 |
| JP | S62241382 | 10/1987 |
| JP | 06054289 | 2/1994 |
| JP | H654103 | 7/1994 |
| JP | 11135274 | 5/1995 |
| JP | 07249467 | 9/1995 |
| JP | 7264036 | 10/1995 |
| JP | 08162677 | 6/1996 |
| JP | H10308536 | 11/1998 |
| JP | H11162234 | 6/1999 |
| JP | H11260125 | 9/1999 |
| JP | 2001238272 | 8/2001 |
| JP | 2001291406 | 10/2001 |
| JP | 2002141555 | 5/2002 |
| JP | 2002289373 | 10/2002 |
| JP | 3098271 | 2/2004 |
| JP | 2004119078 | 4/2004 |
| JP | 2004273234 | 9/2004 |
| JP | 2004335426 | 11/2004 |
| JP | 2005158363 | 6/2005 |
| JP | 2005166617 | 6/2005 |
| JP | 2005347214 | 12/2005 |
| JP | 2006012859 | 1/2006 |
| JP | 2006507641 | 3/2006 |
| JP | 2005322866 | 12/2006 |
| JP | 2007227342 | 9/2007 |
| JP | 3139714 | 2/2008 |
| JP | 2008186758 | 8/2008 |
| JP | 2008258124 | 10/2008 |
| JP | 2008293753 | 12/2008 |
| JP | 3154200 | 9/2009 |
| JP | 2009283183 | 12/2009 |
| JP | 201015754 | 1/2010 |
| JP | 4491695 | 6/2010 |
| JP | 2010192229 | 9/2010 |
| JP | 2010205553 | 9/2010 |
| JP | 2012221636 | 11/2012 |
| KR | 1020040008244 | 1/2004 |
| KR | 1020060112113 | 10/2006 |
| KR | 200430022 | 11/2006 |
| KR | 1020060133784 | 12/2006 |
| KR | 1020070063595 | 6/2007 |
| KR | 100781652 | 12/2007 |
| KR | 100844538 | 7/2008 |
| KR | 100888669 | 3/2009 |
| KR | 100927851 | 11/2009 |
| KR | 101475888 | 12/2014 |
| TW | M337036 | 7/2008 |
| TW | M349465 | 1/2009 |
| WO | WO 9906759 | 2/1999 |
| WO | WO 9910867 | 3/1999 |
| WO | WO 9931560 | 6/1999 |
| WO | WO 99/45312 | 9/1999 |
| WO | WO 99/57945 | 11/1999 |
| WO | WO 00/01067 | 1/2000 |
| WO | WO 0225842 | 3/2002 |
| WO | WO 0261330 | 8/2002 |
| WO | WO 02069306 | 9/2002 |
| WO | WO 02091805 | 11/2002 |
| WO | WO 02098182 | 12/2002 |
| WO | WO 02099780 | 12/2002 |
| WO | WO 03026358 | 3/2003 |
| WO | WO 03055273 | 7/2003 |
| WO | WO 03067934 | 8/2003 |
| WO | WO 03090890 | 11/2003 |
| WO | WO 03096761 | 11/2003 |
| WO | WO 2004021747 | 3/2004 |
| WO | WO 2004023850 | 3/2004 |
| WO | WO 2004032572 | 4/2004 |
| WO | WO 2004057924 | 7/2004 |
| WO | WO 2004100624 | 11/2004 |
| WO | WO 2005031860 | 4/2005 |
| WO | WO 2005052751 | 6/2005 |
| WO | WO 2005060309 | 6/2005 |
| WO | WO 2005084339 | 9/2005 |
| WO | WO 2005089293 | 9/2005 |
| WO | WO 2005089309 | 9/2005 |
| WO | WO 2005103555 | 11/2005 |
| WO | WO 2005116519 | 12/2005 |
| WO | WO 2006023149 | 3/2006 |
| WO | WO 2006044328 | 4/2006 |
| WO | WO 2006046207 | 5/2006 |
| WO | WO 2006056120 | 6/2006 |
| WO | WO 2006093889 | 9/2006 |
| WO | WO 2006095315 | 9/2006 |
| WO | WO 2006095316 | 9/2006 |
| WO | WO 2006127666 | 11/2006 |
| WO | WO 2006127785 | 11/2006 |
| WO | WO 2006133272 | 12/2006 |
| WO | WO 2006137686 | 12/2006 |
| WO | WO 2007004679 | 1/2007 |
| WO | WO 2007081674 | 7/2007 |
| WO | WO 2007090292 | 8/2007 |
| WO | WO 2007094810 | 8/2007 |
| WO | WO 2007143991 | 12/2007 |
| WO | WO 2008018002 | 2/2008 |
| WO | WO 2008027093 | 3/2008 |
| WO | WO 2008061991 | 5/2008 |
| WO | WO 2008110978 | 9/2008 |
| WO | WO 2008129488 | 10/2008 |
| WO | WO 2008137460 | 11/2008 |
| WO | WO 2009061124 | 5/2009 |
| WO | WO 2009067074 | 5/2009 |
| WO | WO 2009111978 | 9/2009 |
| WO | WO 2009/139610 | 11/2009 |
| WO | WO 2009143047 | 11/2009 |
| WO | WO 2010011911 | 1/2010 |
| WO | WO 2010014437 | 2/2010 |
| WO | WO 2010030509 | 3/2010 |
| WO | WO 2010047898 | 4/2010 |
| WO | WO 2010047973 | 4/2010 |
| WO | WO 2010069983 | 6/2010 |
| WO | WO 2010083370 | 7/2010 |
| WO | WO 2010088105 | 8/2010 |
| WO | WO 2010132625 | 11/2010 |
| WO | WO 2010141537 | 12/2010 |
| WO | WO 2011005562 | 1/2011 |
| WO | WO 2011005579 | 1/2011 |
| WO | WO 2011021119 | 2/2011 |
| WO | WO 2011014884 | 6/2011 |
| WO | WO 2011072308 | 6/2011 |
| WO | WO 2011113709 | 9/2011 |
| WO | WO 2011117059 | 9/2011 |
| WO | WO 2011159436 | 12/2011 |
| WO | WO 2012001584 | 1/2012 |
| WO | WO 2012004708 | 1/2012 |
| WO | WO 2012007899 | 1/2012 |
| WO | WO 2012019535 | 2/2012 |
| WO | WO 2012025626 | 3/2012 |

(56) References Cited

FOREIGN PATENT DOCUMENTS

| | | |
|---|---|---|
| WO | WO 2012063174 | 5/2012 |
| WO | WO 2012117018 | 9/2012 |
| WO | WO 2012129301 | 9/2012 |
| WO | WO 2012131522 | 10/2012 |
| WO | WO 2012131547 | 10/2012 |
| WO | WO 2013028965 | 2/2013 |
| WO | WO 2013029960 | 3/2013 |
| WO | WO 2013030128 | 3/2013 |
| WO | WO 2013045255 | 4/2013 |
| WO | WO 2013045439 | 4/2013 |
| WO | WO 2013057660 | 4/2013 |
| WO | WO 2013079242 | 6/2013 |
| WO | WO 2013088299 | 6/2013 |
| WO | WO 2013097823 | 7/2013 |
| WO | WO 2013098700 | 7/2013 |
| WO | WO 2013113548 | 8/2013 |
| WO | WO 2013113661 | 8/2013 |
| WO | WO 2013121347 | 8/2013 |
| WO | WO 2013132383 | 9/2013 |
| WO | WO 2013135527 | 9/2013 |
| WO | WO 2013167419 | 11/2013 |

OTHER PUBLICATIONS

United States Notice of Allowance issued in U.S. Appl. No. 14/826,505 dated Oct. 2, 2018, 11 pages.

Airport International. Fly High With Intelligent Airport Building and Security Solutions [online], [retrieved on Oct. 24, 2008]. Retrieved from Airport International web page using Internet <URL: http://www.airport-int.com/ categories/airport-building-and-security-solutions/fly-high-with-intelligent-airport-building-and-security-solutions.html>.

Best Practice Guide—Commercial Office Buildings—Central HVAC System. [online], [Retrieved on Jan. 17, 2008] Retrieved from Flex Your Power Organization web page using Internet <URL: http:// www.fypower.org/bpg/module. html?b=offices&m+Central HVAC Systems&s=Contr . . . >.

Cornell University. Light Canopy—Cornell University Solar Decathlon, [online], [retrieved on Jan. 17, 2008] Retrieved from Cornell University web page using Internet <URL: http://cusd.cornell.edu/ cusd/web/index.php/page/ show/section/Design/page/controls>.

D.N.A.-111, [online], [retrieved Mar. 10, 2009] Retrieved from the PLC Lighting Web Page using Internet <URL: http:// www.plclighting.com/product_info.php?cPath =1&products_id=92>.

E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22> _.

E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18> _.

E20524-10 & E20525-10 Curva Collection, [online], [retrieved on Jul. 10, 2010] Retrieved from ET2 Contemporary Lighting using Internet <URL: http://www.et2online.com/proddetail.aspx?Item1D= E20524-10 & E20525-10>.

E20743-09 Stealth Collection, [online], [retrieved on Jul. 10, 2010] Retrieved from ET2 Contemporary Lighting using Internet <URL: http://www.et2onIine.com/proddetail.aspx?ItemlD=E20743-09>.

E22201-44 Esprit Collection, [online], [retrieved on Jul. 10, 2010] Retrieved from ET2 Contemporary Lighting using Internet <URL: http://www.et2onIine.com/proddetail.aspx?ItemlD=E22201-44> _.

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ ballast.pdf.>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http:// securitysolutions.com/mag/security_benefits_building_systems/>.

Hightower et al, "A Survey and Taxonomy of Location Systems for Ubiquitous Computing", University of Washington, Computer Science and Engineering, Technical Report UW-CSE Jan. 8, 2003, IEEE, Aug. 24, 2001 in 29 pages.

Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/ lbnl1871.html>.

LCD Optics 101 Tutorial [online]. 3M Corporation, [retrieved on Jan. 6, 2010]. Retrieved from the internet: <URL: http://solutions.3m.com/wps/portal/3M/en_USNikuiti1/BrandProducts/secondary/ optics101/>_.

LED Lights, Replacement LED lamps for any incandescent light, [online], [retrieved on Jan. 13, 2000] Retrieved from LED Lights Web Page using Internet <URL: http://www.ledlights.com/replac.htm>.

Ledtronics, Ledtronics Catalog, 1996, p. 10, Ledtronics, Torrance, California.

Phason Electronic Control Systems, Light Level Controller (LLC) case study. Nov. 30, 2004. 3 pages, Phason Inc., Winnipeg, Manitoba, Canada.

Philips. Sense and Simplicity—Licensing program for LED Luminaires and Retrofits, Philips Intellectual Property & Standards, May 5, 2009.

Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/ p/articles/mi_qu3922/is_200005/ai_n8899499/>.

PLC-81756-AL "Fireball" Contemporary Pendant Light, [online], [retrieved on Feb. 27, 2009] Retrieved from the Arcadian Lighting Web Page using Internet <URL: http://www.arcadianlighting.com/ plc-81756-al.html>.

PLC-96973-PC PLC Lighting Elegance Modern/Contemporary Pendant Light, [online], [retrieved on Feb. 27, 2009] Retrieved from the Arcadian Lighting Web Page using Internet <URL: http/www.arcadianlighting.com/plc-96978-pc. html>.

Saha et al, "Location Determination of a Mobile Device using IEEE 802.11 Access Point Signals", May 5, 2002 in 20 pages.

Sensor Switch, nlight Lighting Control System, [online], [retrieved on Jan. 11, 2008] Retrieved from Sensor Switch web page using Internet <URL: http://www.sensorswitch.com>.

Six Strategies, [online], [retrieved on Jan. 11, 2008] Retrieved from Encelium Technologies Inc. Web Page using Internet <URL: http:// www.encelium.com/products/strategies.html> _.

Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/ IBT_Archive/BNP_ GUID_9-5-2006_A_10000000000000056772>.

Telecite Products & Services—Display Options, [online], [retrieved on Jan. 13, 2000] Retrieved from Telecite Web page using Internet <URL: http://www.telecite.com/en/products/options en.him>.

Traffic Signal Products—Transportation Products Group, [online], [retrieved on Jan. 13, 2000] Retrieved from the Dialight Web Page using Internet <URL: http://www.dialight.com/trans.htm>.

Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/ leds14.html>.

Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.

Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.

Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http:// www.lrc.rpi.edu/programs/Futures/LF-BAS/index.asp>.

(56) References Cited

OTHER PUBLICATIONS

JP Office Action in Japanese Appln. No. 2017-561998, dated May 13, 2019, 8 pages (with English translation).
CN Office Action in Chinese Appln. No. 201580080584.0, dated Jul. 16, 2019, 16 pages (with English translation).
EP Office Action in European Appln. No. 15760328.3, dated Mar. 27, 2019, 7 pages.
CN Office Action in Chinese Appln. No. 201580080584.0, dated Apr. 26, 2020, 15 pages (with English translation).

* cited by examiner

LED-BASED LIGHT WITH CANTED OUTER WALLS

CROSS REFERENCE TO RELATED APPLICATION

This application is a continuation of U.S. application Ser. No. 14/826,505, filed Aug. 14, 2015, now U.S. Pat. No. 10,161,568, issued Dec. 25, 2018, which claims priority to U.S. Provisional Patent Application Ser. No. 62/169,050, filed on Jun. 1, 2015. The contents of all of the prior applications are incorporated here by reference in their entirety.

TECHNICAL FIELD

The embodiments disclosed herein relate to a light emitting diode (LED)-based light for replacing a fluorescent light in a standard fluorescent light fixture.

BACKGROUND

Fluorescent lights are widely used in a variety of locations, such as schools and office buildings. Although conventional fluorescent lights have certain advantages over, for example, incandescent lights, they also pose certain disadvantages including, inter alia, disposal problems due to the presence of toxic materials within the light.

LED-based lights designed as one-for-one replacements for fluorescent lights have appeared in recent years.

SUMMARY

Disclosed herein are embodiments of LED-based lights. One embodiment of an LED-based light has an elongate housing having a longitudinal axis and a vertical axis, the housing defined by a base and two canted outer walls meeting opposite the base, the housing defining a cavity. An LED circuit board on which a plurality of LEDs are located is positioned within the cavity. End caps are positioned at opposite ends of the housing.

Another embodiment of an LED-based light has an elongate housing having longitudinal axis and a vertical axis, the housing defining a cavity having a width that varies along the vertical axis, the width including a greatest width below a vertical center of the vertical axis. An LED circuit board on which a plurality of LEDs are located is positioned within the housing. End caps are positioned at opposite ends of the housing.

Another embodiment of an LED-based light comprises an elongate housing comprising a base extending substantially along a horizontal and two canted outer walls extending from the base and canting toward each other, wherein a portion of a profile of each of the two canted outer walls between a line tangent to the profile and 45° from horizontal and a line tangent to the profile and 90° from the horizontal is greater than 30 percent, the housing defining a cavity. An LED circuit board on which a plurality of LEDs is positioned within the cavity. An end cap is located at each end of the housing.

BRIEF DESCRIPTION OF THE DRAWINGS

The various features, advantages and other uses of the present apparatus will become more apparent by referring to the following detailed description and drawings in which.

DETAILED DESCRIPTION

Figure 1:
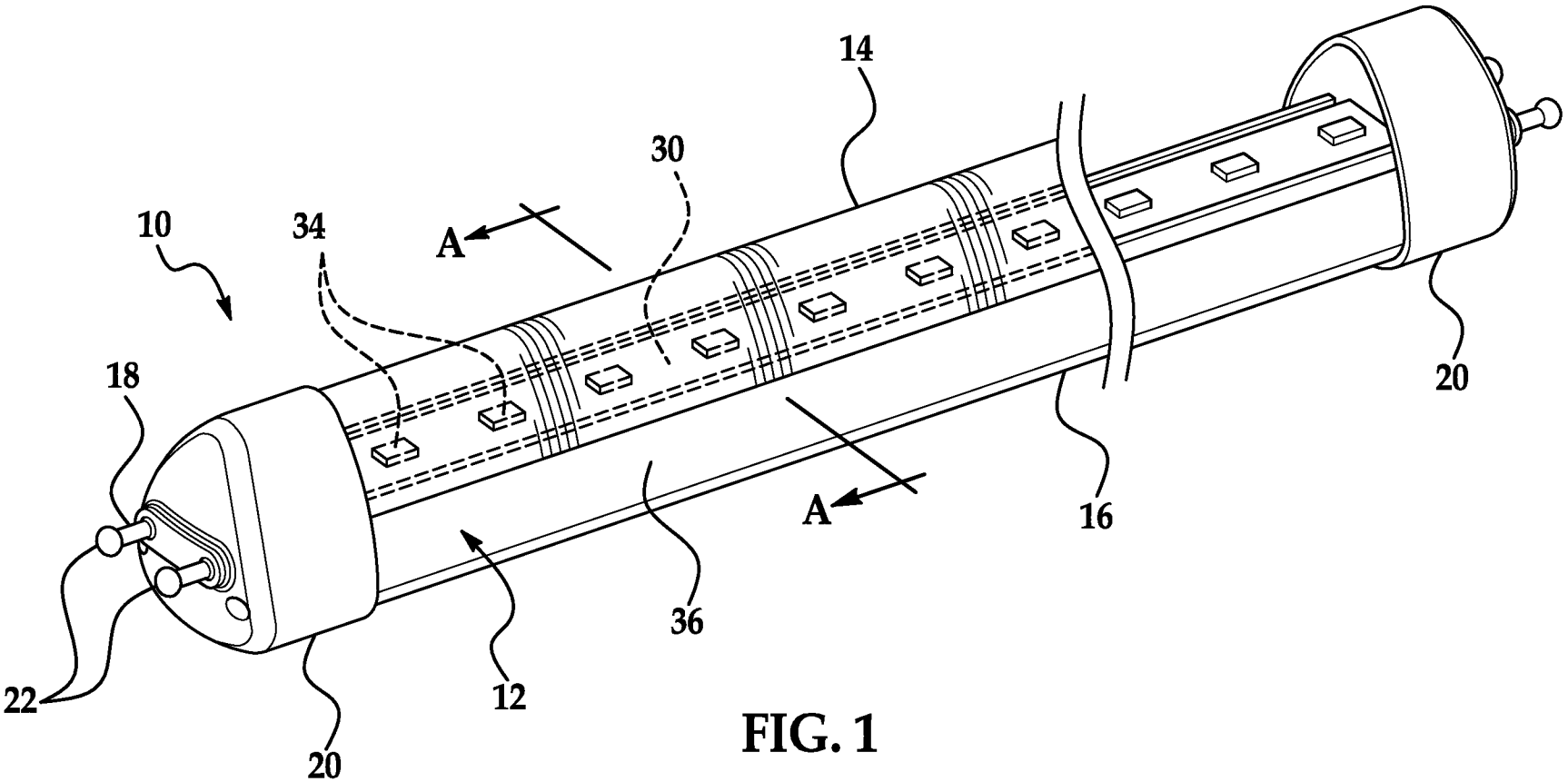
FIG. 1 is a partial perspective view of a first example of an LED-based light including an LED circuit board, a housing for the LED circuit board and a pair of end caps positioned at the ends of the housing.
Figure 2A:
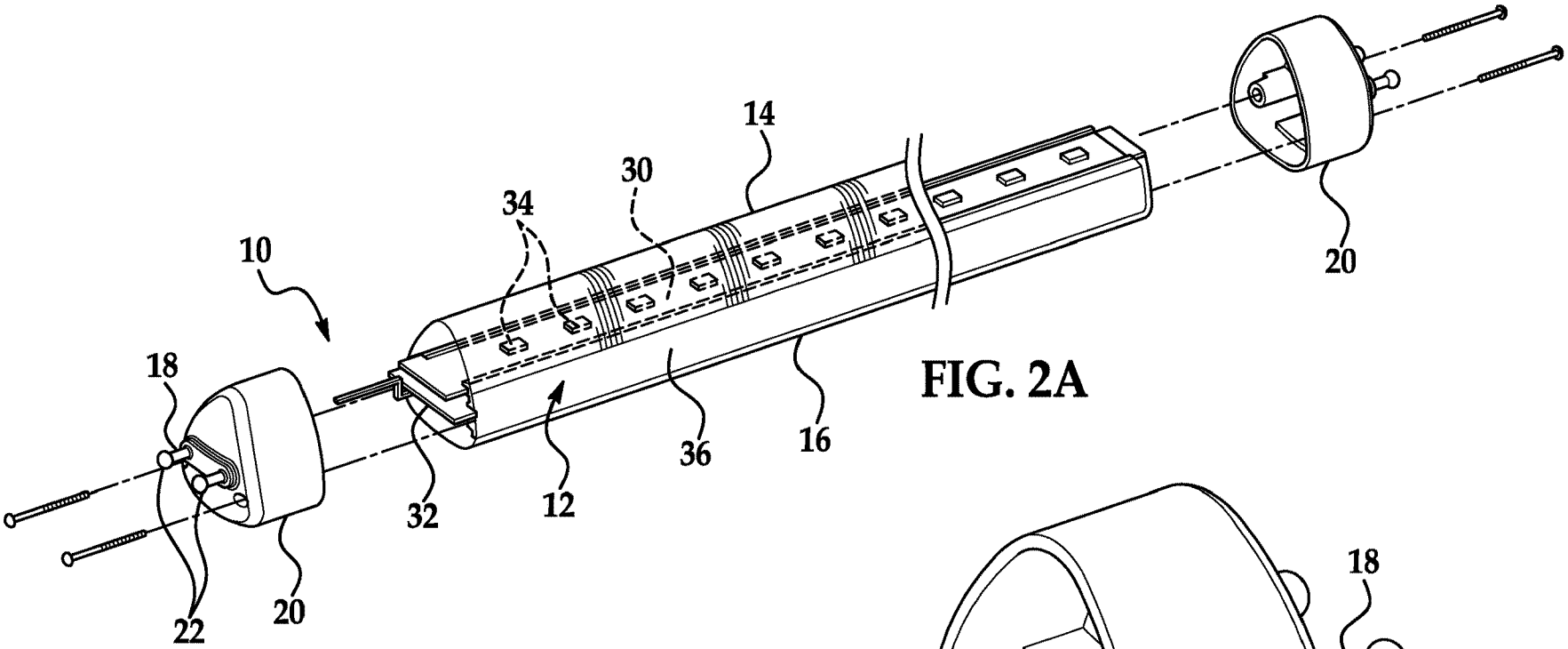
FIG. 2A is a perspective partial assembly view of the LED-based light of FIG. 1 with the end caps removed, showing the LED circuit board and a power supply circuit board.

A first example of an LED-based light 10 for replacing a conventional light in a standard light fixture is illustrated in FIGS. 1 and 2A. The LED-based light 10 includes a housing 12 and has a pair of end caps 20 positioned at the ends of the housing 12. An LED circuit board 30 including LEDs 34, a power supply circuit board 32 and a support 36 are arranged within the housing 12.

The housing 12 of the LED-based light 10 can generally define a single package sized for use in a standard fluorescent light fixture. In the illustrated example, the pair of end caps 20 is attached at opposing longitudinal ends of the housing 12 for physically connecting the LED-based light 10 to a light fixture. As shown, each end cap 20 carries an electrical connector 18 configured to physically connect to the light fixture. The electrical connectors 18 can be the sole physical connection between the LED-based light 10 and the light fixture. One example of a light fixture for the LED-based light 10 is a troffer designed to accept conventional fluorescent lights, such as T5, T8 or T12 fluorescent tube lights. These and other light fixtures for the LED-based light 10 can include one or more sockets adapted for physical engagement with the electrical connectors 18. Each of the illustrated electrical connectors 18 is a bi-pin connector including two pins 22. Bi-pin electrical connectors 18 are compatible with many fluorescent light fixtures and sockets, although other types of electrical connectors can be used, such as a single pin connector or a screw type connector.

The light fixture can connect to a power source, and at least one of the electrical connectors 18 can additionally electrically connect the LED-based light 10 to the light fixture to provide power to the LED-based light 10. In this example, each electrical connector 18 can include two pins 22, although two of the total four pins can be "dummy pins" that provide physical but not electrical connection to the light fixture. The light fixture can optionally include a ballast for electrically connecting between the power source and the LED-based light 10.

The housing 12 is an elongate, light transmitting tube at least partially defined by a lens 14 opposing the LEDs 34. The term "lens" as used herein means a light transmitting structure, and not necessarily a structure for concentrating or diverging light. While the illustrated housing 12 is linear, housings having an alternative shape, e.g., a U-shape or a circular shape can alternatively be used. The LED-based light 10 can have any suitable length. For example, the LED-based light 10 may be approximately 48" long, and the housing 12 can have a 0.625", 1.0" or 1.5" diameter for engagement with a standard fluorescent light fixture.

The housing 12, as generally shown, can be formed as an integral whole including the lens 14 and a lower portion 16. The lens 14 can be made from polycarbonate, acrylic, glass or other light transmitting material (i.e., the lens 14 can be transparent or translucent). The lower portion 16 can be made from the same polycarbonate, acrylic, glass or other light transmitting material as the lens 14, or, can be made of a similar opaque material. The housing 12 may be formed by extrusion, for example. Optionally, the lens 14, made from a light transmitting material, can be coextruded with a lower portion made from opaque material to form the housing 12. Alternatively, the housing 12 can be formed by connecting multiple individual parts, not all of which need be light transmitting.

The support 36 is arranged within the housing 12. The support 36, as generally shown, is elongate and may support one or both of the LED circuit board 30 and the power supply circuit board 32 inside of the housing 12.

Figure 2B:
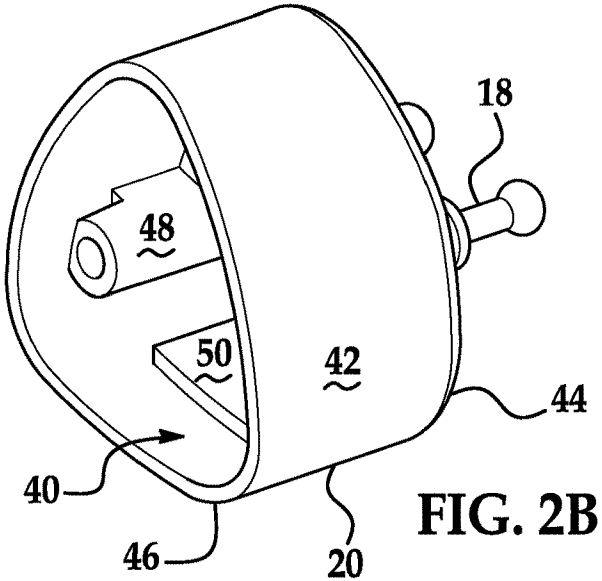
FIG. 2B is an enlarged view of an end cap removed from the housing.

In the illustrated example of the LED-based light 10, the support 36 can additionally support, in whole or in part, the end caps 20, the housing 12, or both. With reference to FIG. 2B, each of the end caps 20 defines a socket 40 sized and shaped to receive and retain an end of the housing 12. The attachment of the end caps 20 at the opposing ends of the support 36 fixes the position and orientation of the sockets 40 to retain the housing 12 in its arrangement around the support 36, the LED circuit board 30 and the power supply circuit board 32. The end caps 20 may, as shown, be attached to the opposing ends of the support 36 by threaded fasteners, for example. The ends of the housing 12 can have a recess around a circumference of the ends so that exterior surfaces of the end caps 20 are flush with the exterior surface of the housing 12.

In the illustrated example in FIG. 2B, each of the end caps 20 is generally tubular, with an annular sidewall 42, a first, closed end 44 bordering the electrical connector 18 and a second, open end 46 in communication with the socket 40. The socket 40 may, as shown, be defined in part by the interior of the annular sidewall 42. According to this example, the interior of the annular sidewall 42 is generally sized and shaped to receive and circumscribe the exterior of an end of the housing 12. Additionally, or alternatively, the socket 40 may, as shown, be defined in part by a retaining member 48 spaced in opposition to the interior of the annular sidewall 42 and generally sized and shaped to receive the interior of an end of the housing 12. In this example, the socket 40 generally constrains translational travel of the housing 12 relative to the end cap 20. One or more shoulder surfaces 50 may additionally be defined at a distal portion of the socket 40 to configure the socket 40 to generally constrain longitudinal travel of the housing 12 relative to the end cap 20. The shoulder surfaces 50 may, as shown, extend from the annular sidewall 42.

In one example of the LED-based light 10, one or both of the sockets 40 defined by the end caps 20 can be shaped and sized to receive an end of the housing 12 with play permissive of small amounts of translational travel of the housing 12 relative to the end cap 20, of small amounts of longitudinal travel of the housing 12 relative to the end cap 20, or both. The play, for instance, may accommodate differing amounts of thermal expansion between the housing 12 and the support 36 to which the end caps 20 are attached. In other examples of the LED-based light 10, it will be understood that one or both of the sockets 40 defined by the end caps 20 can be shaped and sized to receive an end of the housing 12 substantially without play.

Figure 3A:
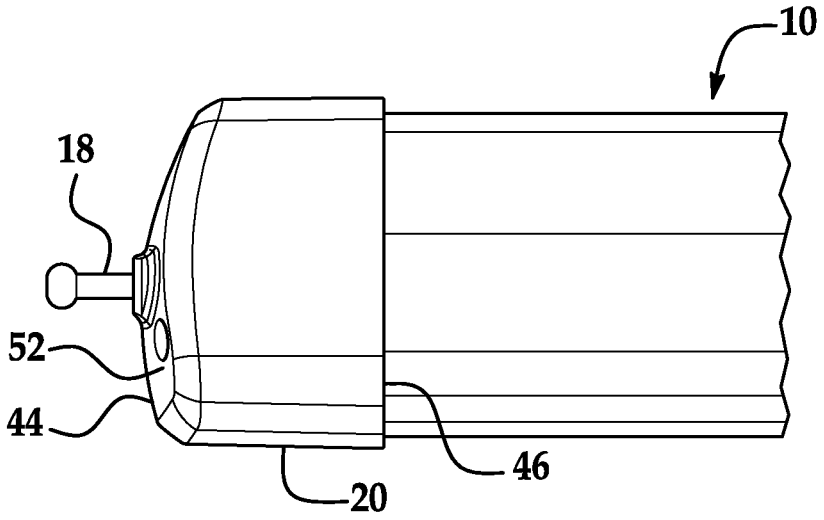
FIGS. 3A-C are additional views of one of the pair of end caps of the LED-based light of FIG. 1.
Figure 3B:
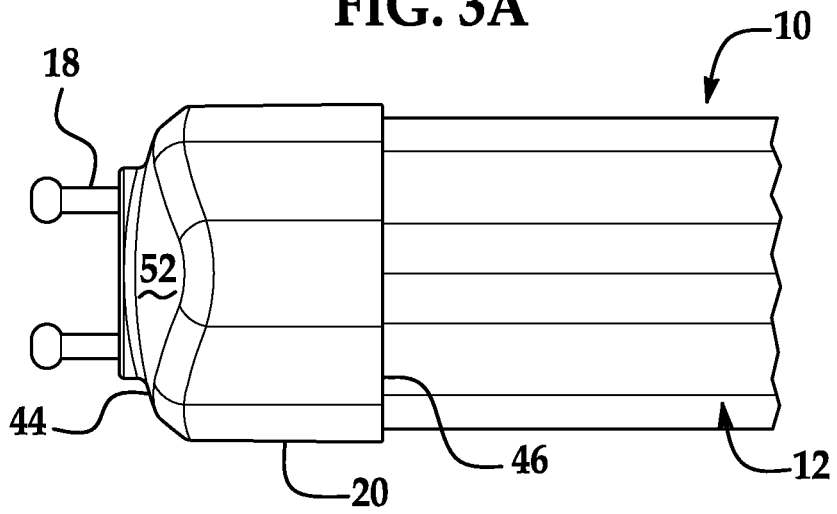
Figure 3C:
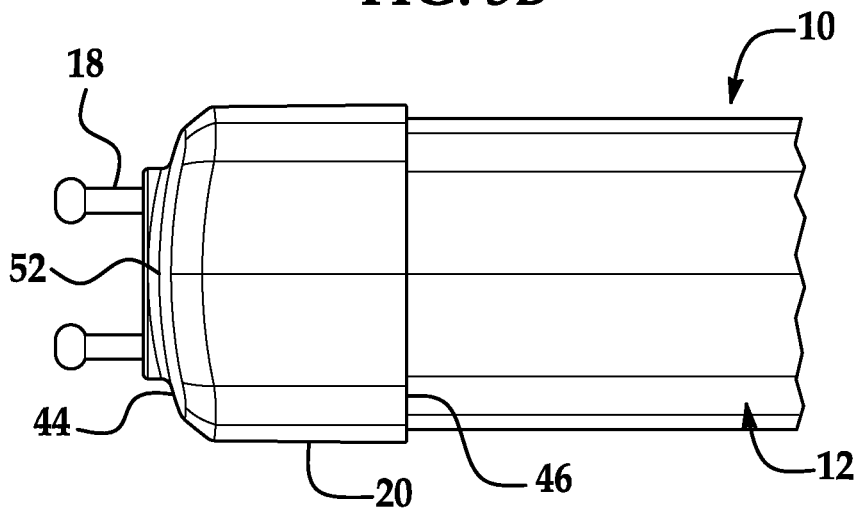

With reference to FIGS. 3A-3C, in the illustrated example of the LED-based light 10, the closed end 44 of one or both of the end caps 20 can define one or more tapered surfaces 52. As shown, the tapered surfaces 52 are tapered away from the closed end 44 and towards the remainder of the end cap 20 and the LED-based light 10.

Figure 4:
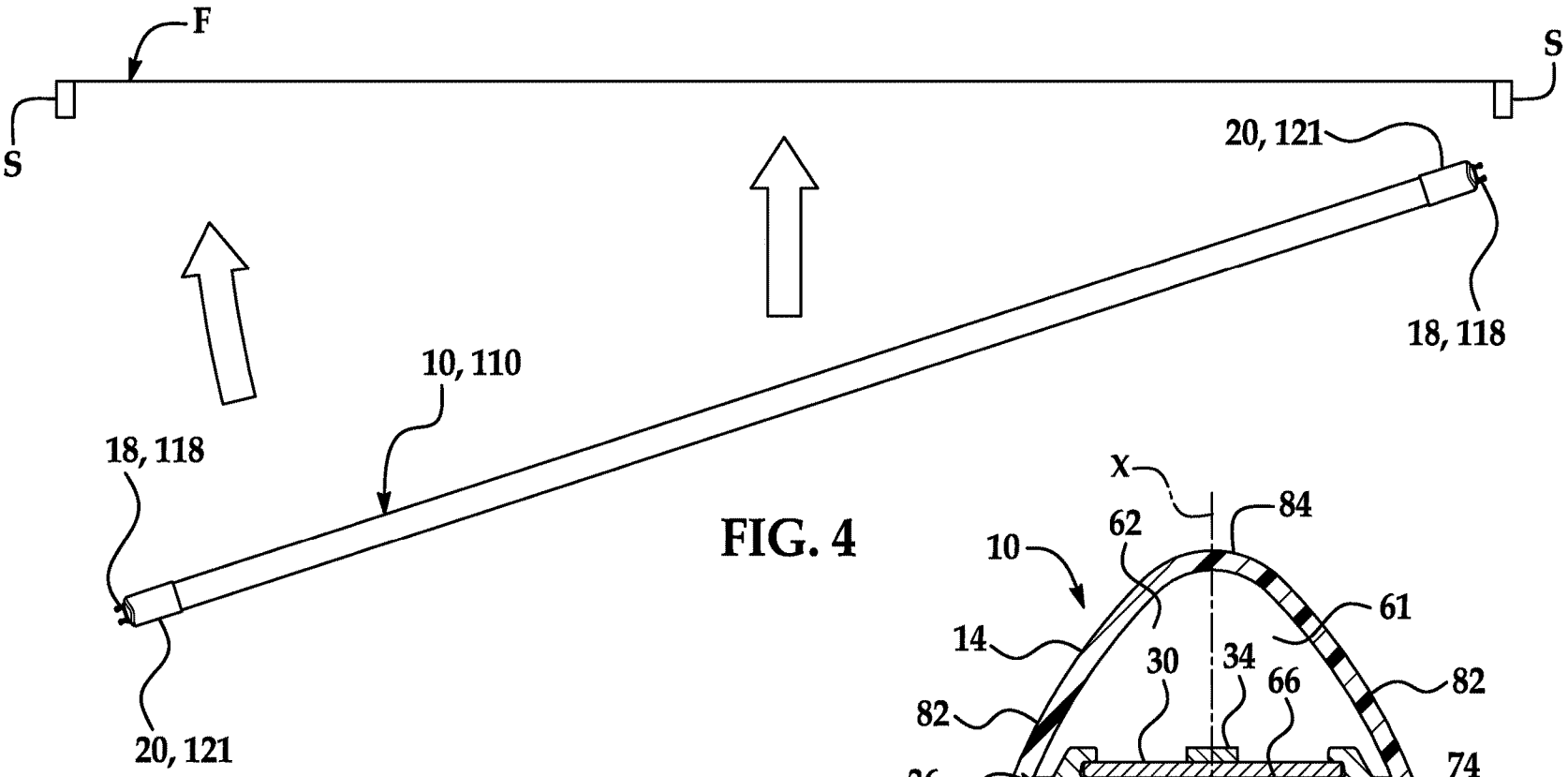
FIG. 4 is a plan view showing an example installation of the LED-based light of FIG. 1 and the LED-based light of FIG. 7 in a light fixture.

The tapered surfaces 52 may, for example, facilitate installation of the LED-based light 10. As shown with additional reference to FIG. 4, the LED-based light 10 may be installed in a light fixture F with a pair of opposing sockets S each adapted for physical engagement with the electrical connector 18 carried by an end cap 20. To install the LED-based light 10 in the light fixture F, typically, after one of the end caps 20 is connected to one of the sockets S, the remainder of the LED-based light 10 is swung towards the light fixture F to position the other end cap 20 near the other socket S for connection. The tapered surfaces 52 may facilitate installation of the LED-based light 10 by preventing either or both of the end caps 20 from hanging up on the sockets S.

The tapered surfaces 52 may be included on one, some or all of the portions of the closed end 44 bordering the electrical connector 18. In the illustrated example, each of the portions of the closed end 44 bordering the electrical connector 18 is includes a tapered surface 52 tapered away from the closed end 44 and towards the remainder of the end cap 20 and the LED-based light 10, giving the closed end 44 of the end cap 20 a generally domed shaped configuration. In particular, the tapered surfaces 52 are tapered at a corner of the end cap 20 that is opposite the base of the housing 12.

Figure 5:
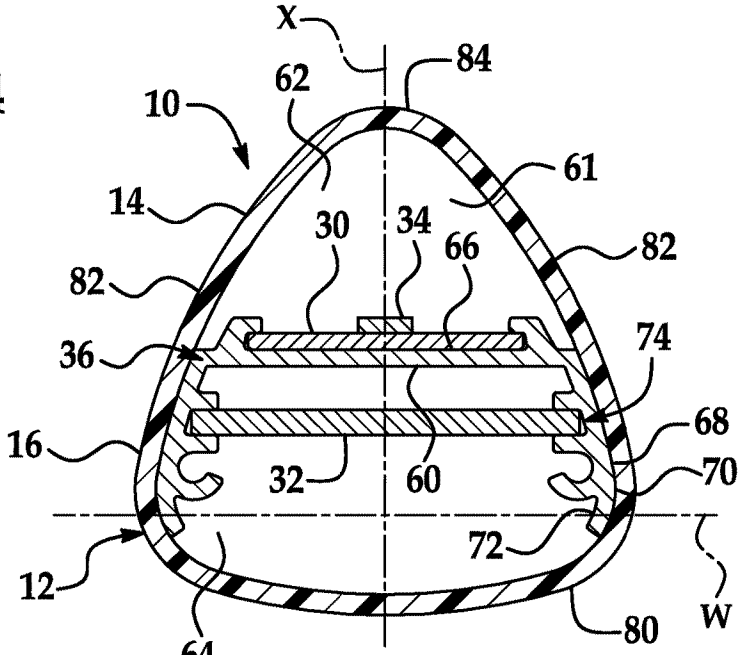
FIG. 5 is a cross section of the LED-based light of FIG. 1 taken at a position similar to the line A-A in FIG. 1.

With additional reference to FIG. 5, the support 36 includes an elongate planar portion 60 arranged across the inside of the housing 12, giving the housing 12 a generally bipartite configuration, splitting cavity 61 into a first cavity 62 defined between the planar portion 60 of the support 36 and the lens 14, and a second cavity 64 defined between the planar portion 60 of the support 36 and the lower portion 16 of the housing 12.

As shown, the planar portion 60 defines an LED mounting surface 66 for supporting the LED circuit board 30 across the inside of the housing 12. The LED mounting surface 66 can be substantially flat, so as to support a flat underside of the LED circuit board 30 opposite the LEDs 34. The LED circuit board 30 is positioned within the first cavity 62 and adjacent the lens 14, such that the LEDs 34 of the LED circuit board 30 are oriented to illuminate the lens 14.

The support 36 may additionally include opposed elongate sidewalls 68 extending from the planar portion 60 and at least partially in contact with the housing 12. The outer walls 68 can be outboard edges 68 extending away from the planar portion 60. The outboard edges 68 each define a radially outer portion 70 and a radially inner portion 72. As shown, in each of the outboard edges 68, the radially outer portion 70 may have one or more areas shaped to correspond to the contour of the interior of the housing 12. These one or more areas at the radially outer portion 70 may be a continuous area shaped to correspond to the contour of the interior of the housing 12, or, may be discontinuous areas shaped to correspond to the contour of the interior of the housing 12. These one or more areas at the radially outer portion 70 may, for example, engage the interior of the housing 12 to support, in whole or in part, the housing 12.

The support 36 may be constructed from a thermally conductive material such as aluminum and configured as a heat sink to enhance dissipation of heat generated by the LEDs 34 during operation to an ambient environment surrounding the LED-based light 10. For instance, in the example LED-based light 10, the LED mounting surface 66 may support the flat underside of the LED circuit board 30 opposite the LEDs 34 in thermally conductive relation, and the one or more areas at the radially outer portion 70 in each of the outboard edges 68 shaped to correspond to the contour of the interior of the housing 12 may engage the interior of the housing 12 in thermally conductive relation, to define a thermally conductive heat transfer path from the LEDs 34 to the LED mounting surface 66 and the remainder of the support 36 through the LED circuit board 30, and to the ambient environment surrounding the LED-based light 10 through the outboard edges 68 of the support 36 and the housing 12.

Optionally, if the support 36 is constructed from an electrically conductive material, the housing 12 can be made from an electrically insulative material. In this configuration, the housing 12 can isolate the support 36 from the ambient environment surrounding the LED-based light 10 from a charge occurring in the support 36 as a result of, for instance, a parasitic capacitive coupling between the support 36 and the LED circuit board 30 resulting from a high-frequency starting voltage designed for starting a conventional fluorescent tube being provided to the LED-based light 10.

The power supply circuit board 32 may, as shown, be positioned within the second cavity 64, although it will be understood that the power supply circuit board 32 may also be positioned in other suitable locations, such as within one or both of the end caps 20 or external to the LED-based light 10. As shown, the power supply circuit board 32 may be supported across the inside of the housing 12. The interior of the housing 12 or the support 36 can include features for supporting the power supply circuit board 32. For instance, in the illustrated example of the LED-based light 10, the outboard edges 68 of the support 36 define opposing channels 74 configured to slidably receive outboard portions of the power supply circuit board 32. It will be understood that the channels 62 are provided as a non-limiting example and that the power supply circuit board 32 may be otherwise and/or additionally supported within the second cavity 64.

In one example of the LED-based light 10, referring to FIG. 5, the housing 12 may have a longitudinal axis and a vertical axis X, the housing defining the cavity 61. The cavity 61 can have a width that varies along the vertical axis X, the width including a greatest width W below a vertical center of the vertical axis X. As illustrated in FIG. 5, for example, the housing 12 may have a generally triangular cross sectional profile. The triangular cross sectional profile may be equilateral, as depicted in the figures, or can be isosceles. As shown in FIG. 5, the housing 12 includes a base 80 and opposing outer walls 82 extending from the base 80 and canted towards one another. The outer walls 82 can meet at a rounded crown 84 connecting the outer walls 82. The rounded crown 84 can include any similar shape as shown in FIG. 5, including those shown in FIGS. 12A-12H. In this example of the LED-based light 10, the lens 14 is formed by the rounded crown 84 and at least a portion of the opposing outer walls 82.

Figure 13A:
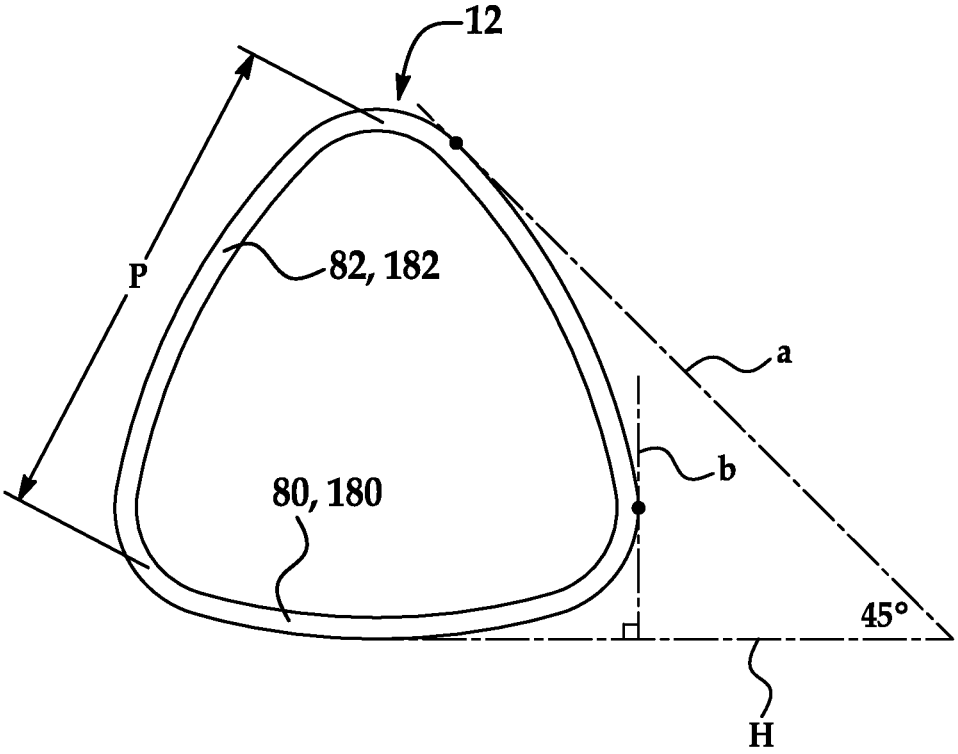
FIG. 13A is a cross section of the housing illustrating that 30% or greater of the profile of a canted outer wall is between a line tangent to the profile and 45° from horizontal and a line tangent to the profile and 90° from the horizontal.
Figure 13B:
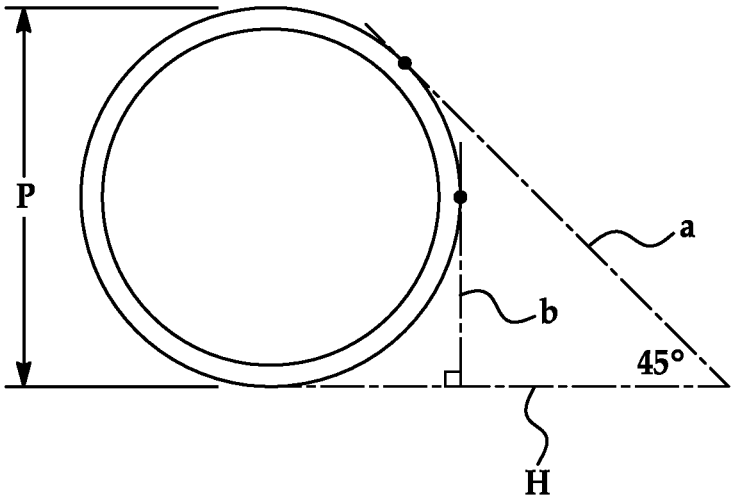
FIG. 13B is a cross section of a conventional housing having a circular cross section, illustrating that only 25% of the profile of the circular housing is between a line tangent to the profile and 45° from horizontal and a line tangent to the profile and 90° from the horizontal.

As illustrated in FIG. 13A, the housing 12 can be configured so that, with the base 80 extending substantially along a horizontal H, each of the two canted outer walls 82 have a profile P such that greater than or equal to 30% of the profile is between a line a tangent to the profile P and 45° from horizontal H and a line b tangent to the profile P and 90° from the horizontal H. This is distinguishable from other profiles. As a non-limiting example, FIG. 13B illustrates a conventional circular housing, the circular housing having a profile P such that 25% of the profile P is between a line a tangent to the profile P and 45° from horizontal H and a line b tangent to the profile P and 90° from the horizontal H.

The generally triangular cross sectional profile of the housing 12 of the LED-based light 10 may allow, for example, for a wider second cavity 64 defined between the planar portion 60 of the support 36 and the lower portion 16 of the housing 12 as compared to an otherwise similar LED-based light with a lower portion formed from a housing having a circular cross sectional profile. This may among other things, for instance, accommodate a wider power supply circuit board 32 within the second cavity 64.

The generally triangular cross sectional profile of the housing 12 of the LED-based light 10 may also allow, for example, for a different optical redistribution by the lens 14 of the light emanating from the LEDs 34 as compared to the optical redistribution, if any, of the light emanating from the LEDs in an otherwise similar LED-based light with a lens formed from a housing having a circular cross sectional profile. Although the description follows with general reference to the spatial aspects of light, it will be understood that the lens 14 of the LED-based light 10 could be additionally configured to modify, for instance, the spectral aspects of the light emanating from the LEDs 34.

Figure 14:
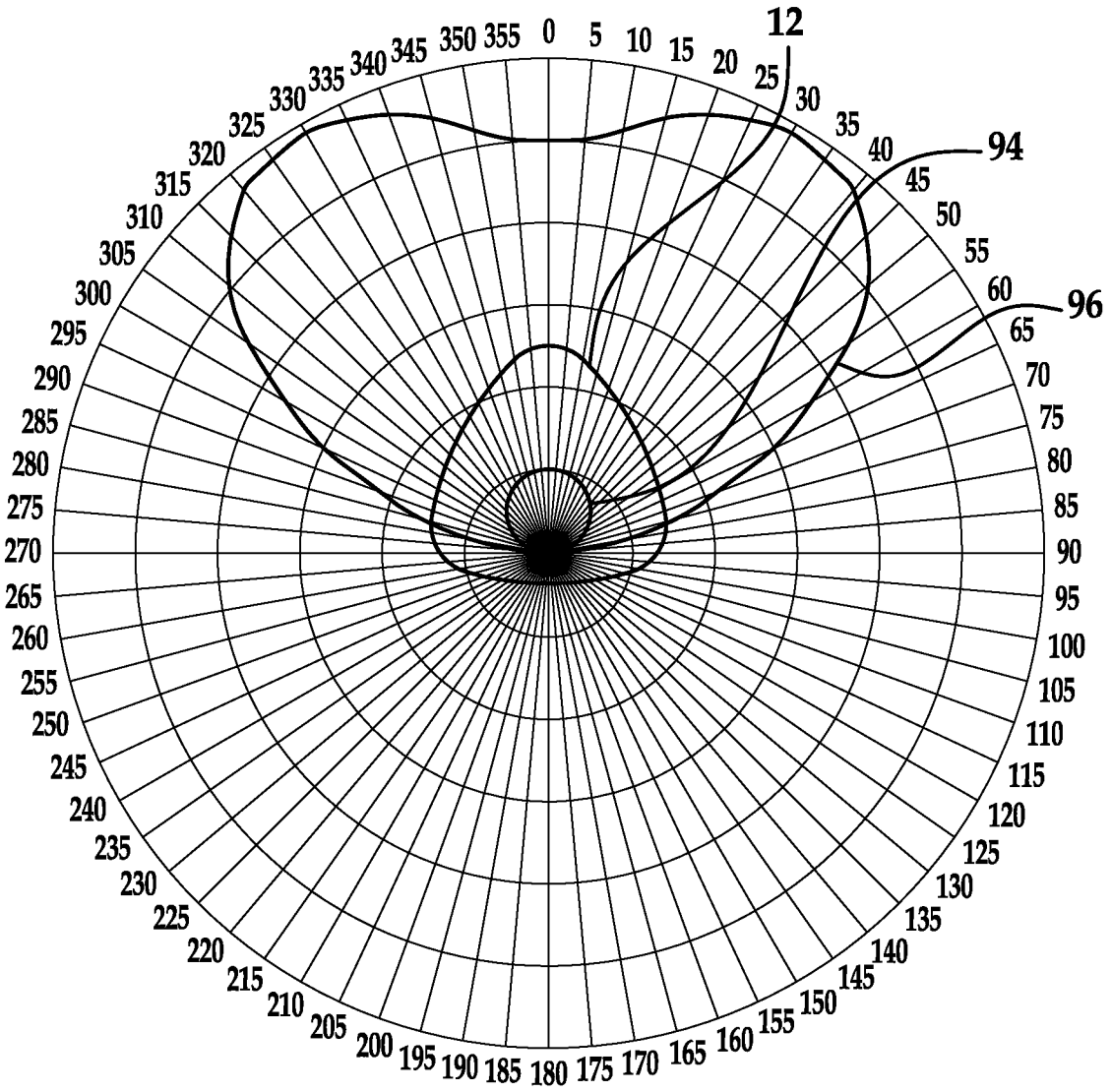
FIG. 14 is an example of light intensity projected onto the internal surface of the housing for the LED-based light of FIG. 10, shown with reference to the housing and the LEDs.

FIG. 14 illustrates the housing 12 and a light profile 94 of the output of the LED. Profile 96 represents the intensity of the light projected onto the internal surfaces of the housing shown in FIGS. 5 and 10. The diffusion in the housing 12 combined with the intensity of the light striking the interior surface of the housing 12 determines the lighting profile as observed from outside the LED-based light. The profile 96 is determined from a combination of the angle of the surface at a given point relative to the LED and the distance of that given point from the LED. The intensity of the LED source is greatest at 0 degrees; however, the distance of the lens at 0 degrees is large and thus the "beam" coming from the LED is spread across a greater portion of the lens, reducing the point intensity.

Figure 6:
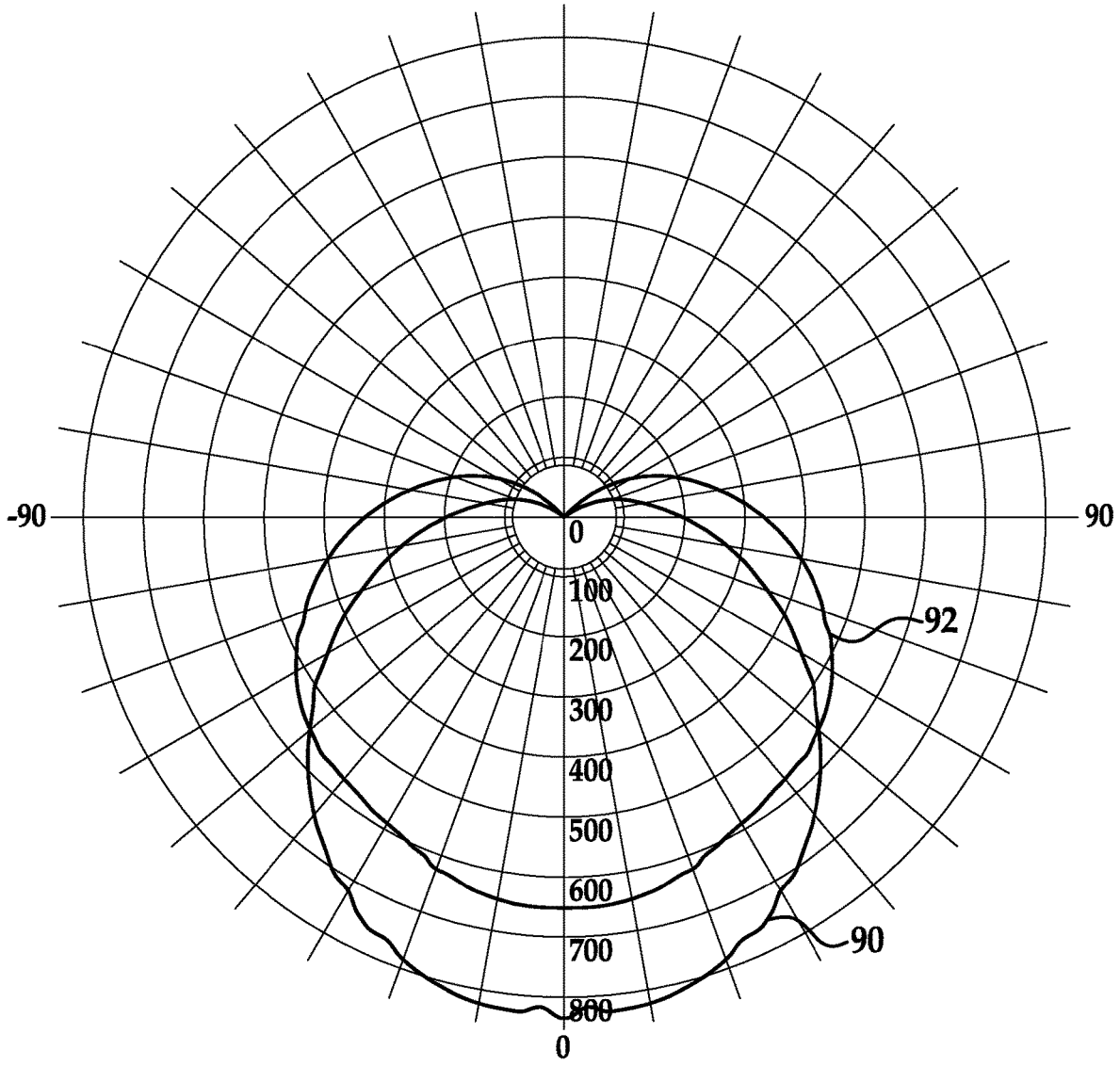
FIG. 6 is an example of a polar light distribution curve for the LED-based light of FIG. 1, shown with reference to the polar light distribution curve for a conventional LED-based light.

The light emanating from both the LEDs 34 in the LED-based light 10 and the LEDs in the otherwise similar LED-based light with a lens formed from a housing having a circular cross sectional profile may be generally directional. In the otherwise similar LED-based light, the generally directional nature of the LEDs may be substantially maintained as the light is transmitted through the lens. An example of a resulting light distribution 90 for the otherwise similar LED-based light is shown in FIG. 6. As shown, for this LED-based light, the light emanating from the LEDs is generally directionally distributed in a direction normal to the LEDs (i.e., along 0°), and little if any of the light emanating from the LEDs is distributed in a direction opposite the LEDs.

In the LED-based light 10, the lens 14 may generally be configured to redistribute some or all of the light emanating from the LEDs 34 away from the direction normal to the LEDs 34. The two canted outer walls 82 can be formed of a light transmitting material and configured to maximize an illuminated section of the housing 12 that faces horizontal. For example, as shown in the light distribution 92 in FIG. 6, the light transmitted from the lens 14 may have a "batwing" configuration, or, a configuration with relatively more distribution of light away from 0° as compared to the light distribution 90 achieved with the otherwise similar LED-based light with a lens formed from a housing having a circular cross sectional profile.

In the illustrated example construction of the LED-based light 10, for instance, the lens 14 is formed by a rounded crown 84 connecting the opposing upright outer walls 82 and some or all of the opposing outer walls 82. It has been found that both increasing cant of the opposing outer walls 82 towards one another and decreasing distance between the opposing outer walls 82 are effective not only to redistribute relatively more of the light emanating from the LEDs 34 away from 0° and in a direction opposite the LEDs, but also to increase overall optical efficiency of the lens 14.

The LED-based light 10 can include other features for distributing light produced by the LEDs 34. For example, the lens 14 can be manufactured with structures to collimate light produced by the LEDs 34. The light collimating structures can be formed integrally with the lens 14, for example, or can be formed in a separate manufacturing step. In addition to or as an alternative to manufacturing the lens 14 to include light collimating structures, a light collimating film can be applied to the exterior of the lens 14 or placed in the housing 12.

In yet other embodiments, the LEDs 34 can be over molded or otherwise encapsulated with light transmitting material configured to distribute light produced by the LEDs 34. For example, the light transmitting material can be configured to diffuse, refract, collimate and/or otherwise distribute the light produced by the LEDs 34. The over molded LEDs 34 can be used alone to achieve a desired light distribution for the LED-based light 10, or can be implemented in combination with the lens 14 and/or films described above.

The above described or other light distributing features can be implemented uniformly or non-uniformly along a length and/or circumference of the LED-based light 10. These features are provided as non-limiting examples, and in other embodiments, the LED-based light 10 may not include any light distributing features.

The LED circuit board 30 can include at least one LED 34, a plurality of series-connected or parallel-connected LEDs 34, an array of LEDs 34 or any other arrangement of LEDs 34. Each of the illustrated LEDs 34 can include a single diode or multiple diodes, such as a package of diodes producing light that appears to an ordinary observer as coming from a single source. The LEDs 34 can be surface-mount devices of a type available from Nichia, although other types of LEDs can alternatively be used. For example, the LED-based light 10 can include high-brightness semiconductor LEDs, organic light emitting diodes (OLEDs), semiconductor dies that produce light in response to current, light emitting polymers, electro-luminescent strips (EL) or the like. The LEDs 34 can emit white light. However, LEDs that emit blue light, ultra-violet light or other wavelengths of light can be used in place of or in combination with white light emitting LEDs 34.

The orientation, number and spacing of the LEDs 34 can be a function of a length of the LED-based light 10, a desired lumen output of the LED-based light 10, the wattage of the LEDs 34, a desired light distribution for the LED-based light 10 and/or the viewing angle of the LEDs 34.

The LEDs 34 can be fixedly or variably oriented in the LED-based light 10 for facing or partially facing an environment to be illuminated when the LED-based light 10 is installed in a light fixture. Alternatively, the LEDs 34 can be oriented to partially or fully face away from the environment to be illuminated. In this alternative example, the LED-based light 10 and/or a light fixture for the LED-based light 10 may include features for reflecting or otherwise redirecting the light produced by the LEDs into the environment to be illuminated.

For a 48" LED-based light 10, the number of LEDs 34 may vary from about thirty to three hundred such that the LED-based light 10 outputs between 1,500 and 3,000 lumens. However, a different number of LEDs 34 can alternatively be used, and the LED-based light 10 can output any other amount of lumens.

The LEDs 34 can be arranged in a single longitudinally extending row along a central portion of the LED circuit board 30 as shown, or can be arranged in a plurality of rows or arranged in groups. The LEDs 34 can be spaced along the LED circuit board 30 and arranged on the LED circuit board 30 to substantially fill a space along a length of the lens 14 between end caps 20 positioned at opposing longitudinal ends of the housing 12. The spacing of the LEDs 34 can be determined based on, for example, the light distribution of each LED 34 and the number of LEDs 34. The spacing of the LEDs 34 can be chosen so that light output by the LEDs 34 is uniform or non-uniform along a length of the lens 14. In one implementation, one or more additional LEDs 34 can be located at one or both ends of the LED-based light 10 so that an intensity of light output at the lens 14 is relatively greater at the one or more ends of the LED-based light 10. Alternatively, or in addition to spacing the LEDs 34 as described above, the LEDs 34 nearer one or both ends of the LED-based light 10 can be configured to output relatively more light than the other LEDs 34. For instance, LEDs 34 nearer one or both ends of the LED-based light 10 can have a higher light output capacity and/or can be provided with more power during operation.

The power supply circuit board 32 has power supply circuitry configured to condition an input power received from, for example, the light fixture through the electrical connector 18, to a power usable by and suitable for the LEDs 34. In some implementations, the power supply circuit board 32 can include one or more of an inrush protection circuit, a surge suppressor circuit, a noise filter circuit, a rectifier circuit, a main filter circuit, a current regulator circuit and a shunt voltage regulator circuit. The power supply circuit board 32 can be suitably designed to receive a wide range of currents and/or voltages from a power source and convert them to a power usable by the LEDs 34.

As shown, the LED circuit board 30 and the power supply circuit board 32 are vertically opposed and spaced with respect to one another within the housing 12. The LED circuit board 30 and the power supply circuit board 32 can extend a length or a partial length of the housing 12, and the LED circuit board 30 can have a length different from a length of the power supply circuit board 32. For example, the LED circuit board 30 can generally extend a substantial length of the housing 12, and the power supply circuit board 32 can extend a partial length of the housing. However, it will be understood that the LED circuit board 30 and/or the power supply circuit board 32 could be alternatively arranged within the housing 12, and that the LED circuit board 30 and the power supply circuit board 32 could be alternatively spaced and/or sized with respect to one another.

The LED circuit board 30 and the power supply circuit board 32 are illustrated as elongate printed circuit boards. Multiple circuit board sections can be joined by bridge connectors to create the LED circuit board 30 and/or power supply circuit board 32. Also, other types of circuit boards may be used, such as a metal core circuit board. Further, the components of the LED circuit board 30 and the power supply circuit board 32 could be in a single circuit board or more than two circuit boards.

Figure 7:
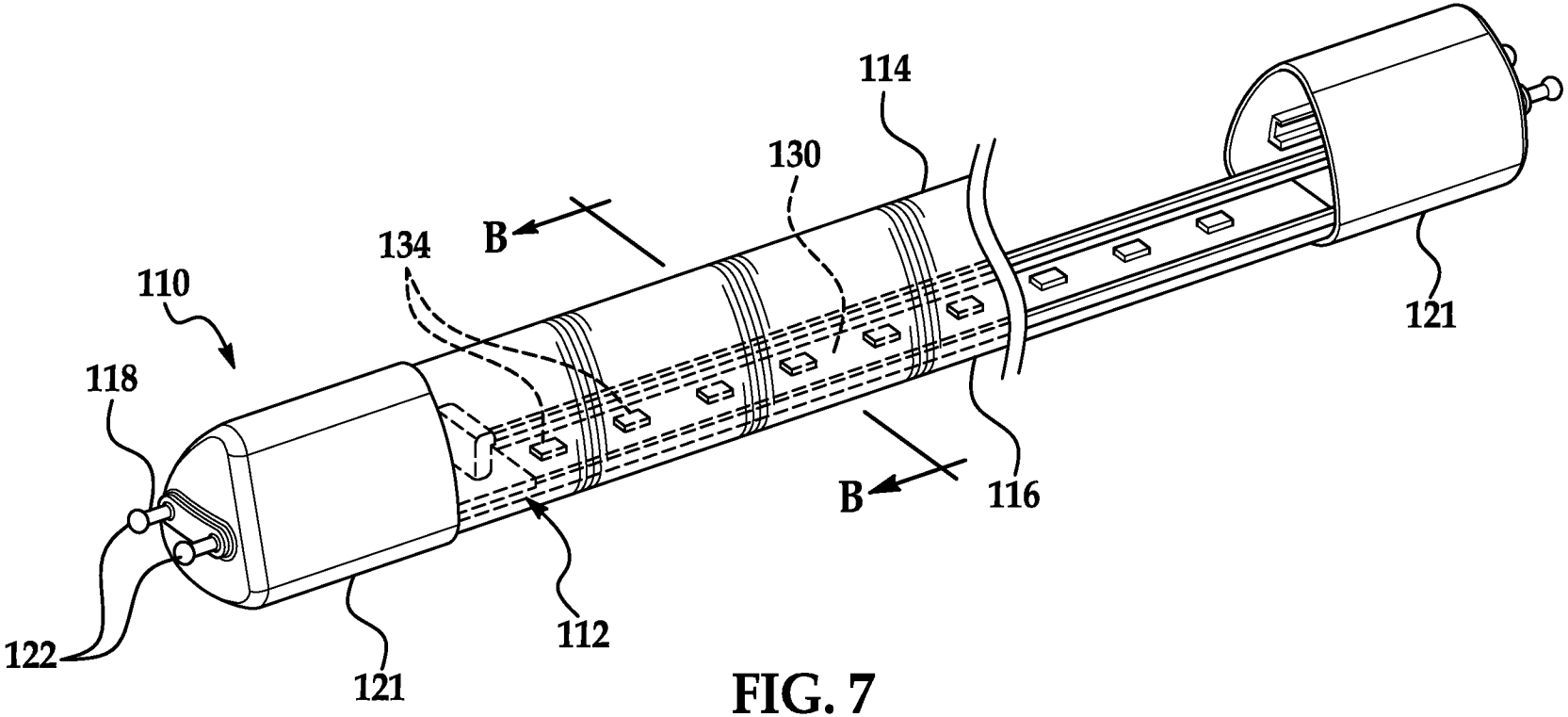
FIG. 7 is a partial perspective view of a second example of an LED-based light including an LED circuit board, a housing for the LED circuit board and a pair of end caps positioned at the ends of the housing.
Figures 8A, 8B:
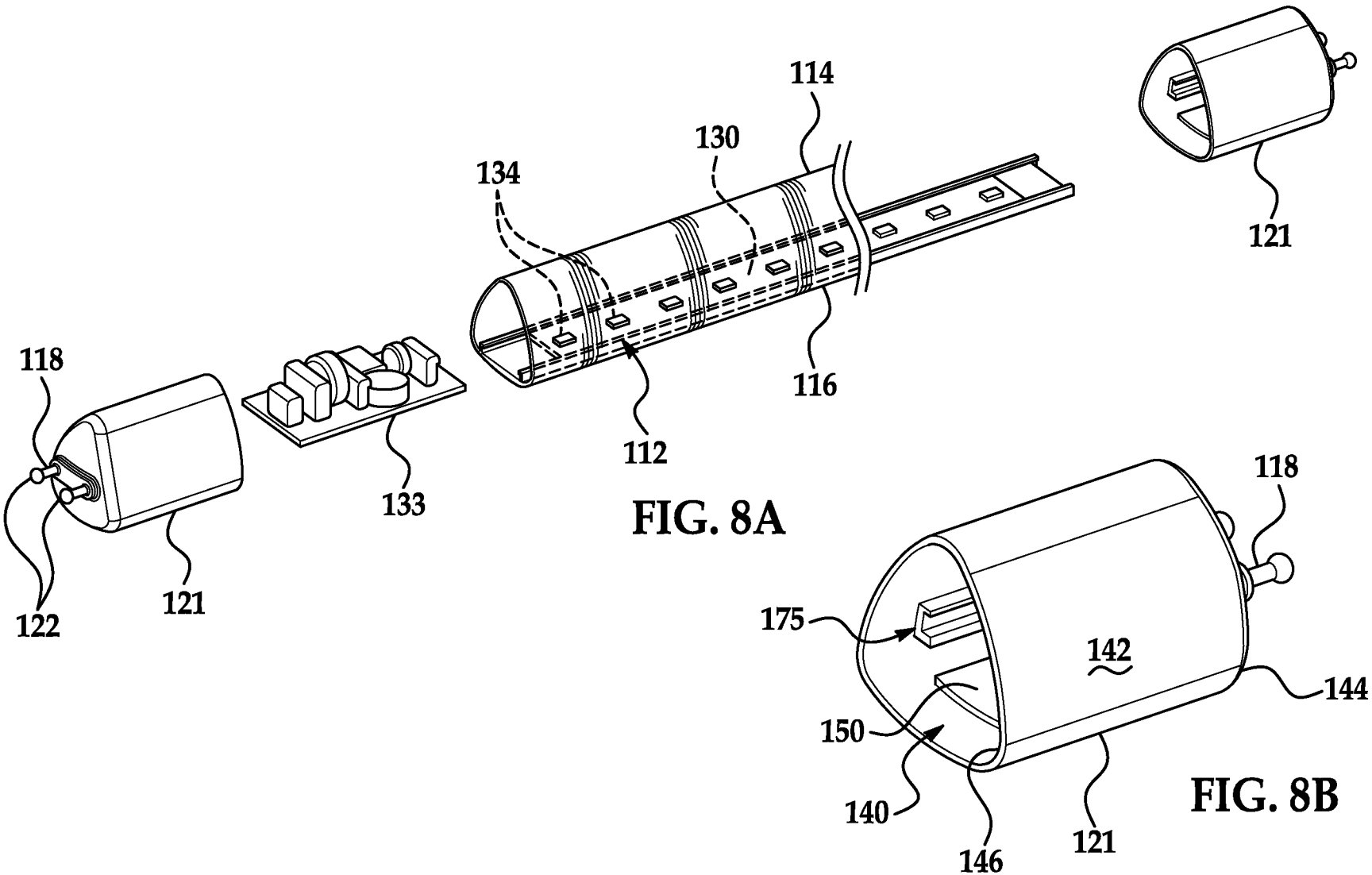
FIG. 8A is a perspective partial assembly view of the LED-based light of FIG. 7 with the end caps removed, showing the LED circuit board and a power supply circuit board.
FIG. 8B is an enlarged view of an end cap removed from the housing.

A second example of an LED-based light 110 for replacing a conventional light in a standard light fixture is illustrated in FIGS. 7 and 8. Components in the LED-based light 110 with like function and/or configuration as components in the LED-based light 10 are designated similarly, with 100-series designations instead of the 10-series designations for the LED-based light 10. For brevity, the full descriptions of these components is not repeated, and only the differences from the LED-based light 10 to the LED-based light 110 are explained below.

The LED-based light 110, similarly to the LED-based light 10, includes a housing 112 and has a pair of end caps 121 positioned at the ends of the housing 112. An LED circuit board 130 including LEDs 134 and a power supply circuit board 133 are arranged within the housing 112. The housing 112 of the LED-based light 110 can generally define a single package sized for use in a standard fluorescent light fixture, as described above.

Compared to the LED-based light 10, the LED-based light 110 does not include the support 36 arranged within the housing 112 to support the LED circuit board 130 and the power supply circuit board 133 across the inside of the housing 112.

In the LED-based light 110, with reference to FIG. 8, each of the end caps 121 defines a socket 140 sized and shaped to receive and retain an end of the housing 112. In the illustrated example, each of the end caps 121 is generally tubular, with an annular sidewall 142, a first, closed end 144 bordering the electrical connector 118 and a second, open end 146 in communication with the socket 140. The socket 140 may, as shown, be defined in part by the interior of the annular sidewall 142. According to this example, the interior of the annular sidewall 142 is generally sized and shaped to receive and circumscribe the exterior of an end of the housing 112. An exterior surface of each end cap 121 can be configured to be flush with an exterior surface of the housing 112. One or more shoulder surfaces 150 may be defined at a distal portion of the socket 140 to configure the socket 140 to generally constrain longitudinal travel of the housing 112 relative to the end cap 121. The shoulder surfaces 150 may, as shown, extend from the annular sidewall 142. The end caps 121 may, for example, be attached to the opposing ends of the housing 112 by threaded fasteners or an adhesive, for example.

In the LED-based light 110, the power supply circuit board 133 extends a partial length of the LED-based light 110, and may be arranged in one or both the end caps 121. In the illustrated example, at least one of the end caps 121 is elongated compared to the end caps 20 of the LED-based light 10 and generally sized and shaped to receive the power supply circuit board 133. The power supply circuit board 133 may, as shown, be a singular package and housed in only one of the end caps 121. Alternatively, it will be understood that the power supply circuit board 133 could include other packages housed in the other of the end caps 121, for example, or otherwise in the housing 112. In some implementations, only the end caps 121 housing the power supply circuit board 133 could be elongated compared to the end caps 20 of the LED-based light 10. Optionally, however, as generally shown, both of end caps 121 may be matching elongated end caps 121 regardless of whether they each house the power supply circuit board 133.

As shown, the power supply circuit board 133 may be supported across the inside of an end cap 121. The interior of the annular outer walls 142 of the end cap 121 can include features for supporting the power supply circuit board 133. For instance, in the illustrated example of the LED-based light 110, interior of the annular outer walls 142 of the end cap 121 define opposing channels 175 configured to slidably receive outboard portions of the power supply circuit board 133. It will be understood that the channels 163 are provided as a non-limiting example and that the power supply circuit board 133 may be otherwise and/or additionally supported across the inside of an end cap 121 or otherwise within the end cap 121.

Figure 9A:
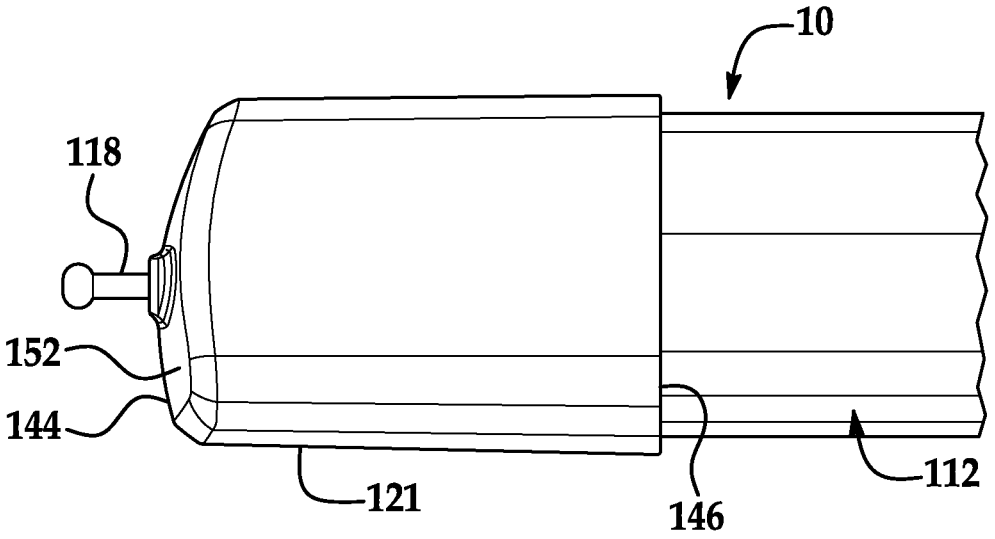
FIGS. 9A-C are additional views of one of the pair of end caps of the LED-based light of FIG. 7.
Figure 9B:
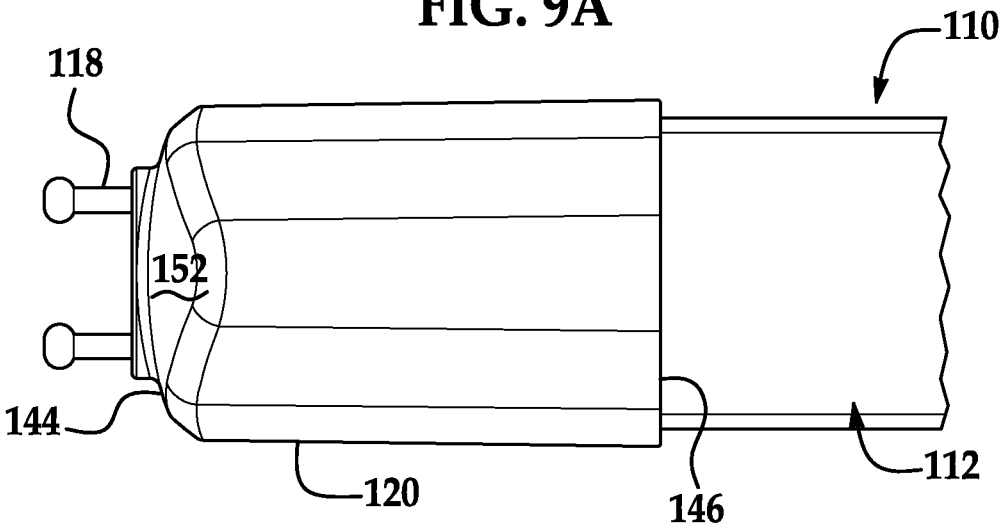
Figure 9C:
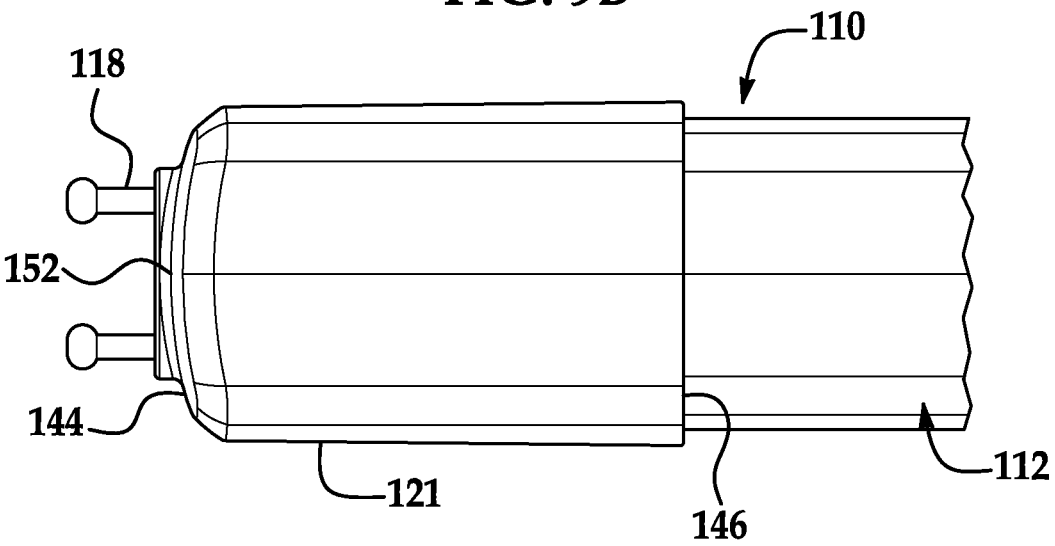

As described above for the LED-based light 10, with reference to FIG. 9, in the illustrated example of the LED-based light 110, the closed end 144 of one or both of the end caps 121 can define one or more tapered surfaces 152 facilitating installation of the LED-based light 110 by preventing either or both of the end caps 121 from hanging up on the sockets S of a light fixture F, as described above with reference to FIG. 4.

Figure 10:
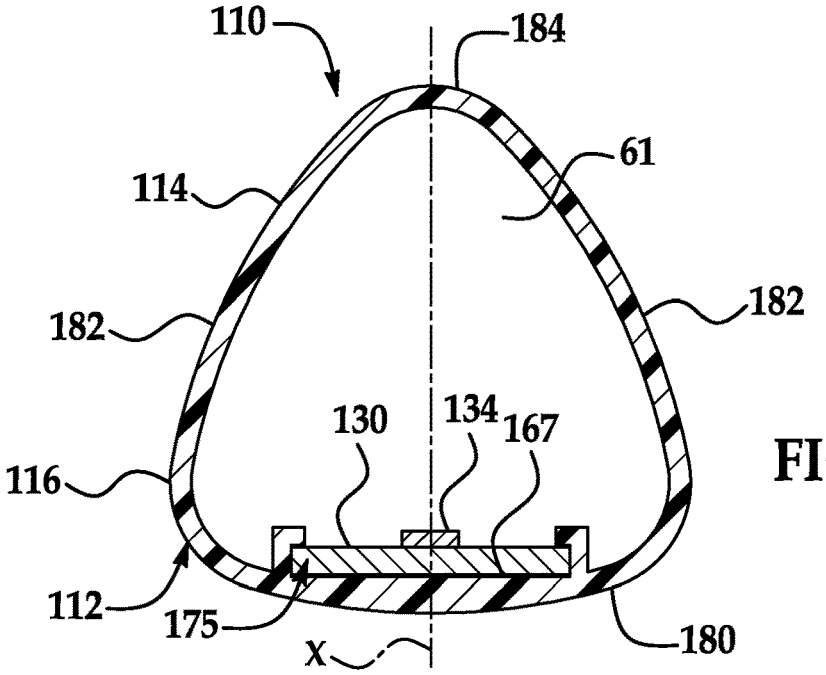
FIG. 10 is a cross section of the LED-based light of FIG. 7 taken at a position similar to the line B-B in FIG. 7.

With additional reference to FIG. 10, in the LED-based light 110, without the support 36 of the LED-based light 10 arranged within the housing 112, the housing 112 defines a cavity 163 between the lens 114 and the lower portion 116 of the housing 112. With the power supply circuit board 133 arranged in one or both the end caps 121, the LED circuit board 130 may be arranged at the base 180 of the housing 112. As shown, base 180 defines an LED mounting surface 167 for supporting the LED circuit board 130. The LED mounting surface 167 can be substantially flat, so as to support a flat underside of the LED circuit board 130 opposite the LEDs 134. The LED circuit board 130 is positioned within the cavity 163 and facing the lens 114, such that the LEDs 134 of the LED circuit board 130 are oriented to illuminate the lens 114.

To enhance dissipation of heat generated by the LEDs 134 during operation to an ambient environment surrounding the LED-based light 110, in the example LED-based light 110, the LED mounting surface 167 may support the flat underside of the LED circuit board 130 opposite the LEDs 134 in thermally conductive relation to define a thermally conductive heat transfer path from the LEDs 134 to the LED mounting surface 167, and to the ambient environment surrounding the LED-based light 110 through the housing 112. Optionally, the housing 112 can be made from an electrically insulative material. In this configuration, the housing 112 can isolate the LED circuit board 130 from the ambient environment surrounding the LED-based light 110 from a charge occurring in the LED circuit board 130 resulting from a high-frequency starting voltage designed for starting a conventional fluorescent tube being provided to the LED-based light 110.

In one example of the LED-based light 110, the housing 112 may have a generally triangular cross sectional profile, as described above for the housing 12 of the LED-based light 10. As shown in FIG. 10, the housing 112 includes a base 180 and opposing upright outer walls 182 extending from the base 180 and canted towards one another. The housing 112 can include a rounded crown 184 connecting the upright outer walls 182.

As illustrated in FIG. 13A, the housing 12 can be configured so that, with the base 180 extending substantially along a horizontal H, each of the two canted outer walls 182 have a profile P such that greater than or equal to 30% of the profile is between a line a tangent to the profile P and 45° from horizontal H and a line b tangent to the profile P and 90° from the horizontal H. This is distinguishable from other profiles. As a non-limiting example, FIG. 13B illustrates a conventional circular housing, the circular housing having a profile P such that 25% of the profile P is between a line a tangent to the profile P and 45° from horizontal H and a line b tangent to the profile P and 90° from the horizontal H.

The generally triangular cross sectional profile of the housing 112 of the LED-based light 110 may also allow, for example, for a different optical redistribution by the lens 114 of the light emanating from the LEDs 134 as compared to the optical redistribution, if any, of the light emanating from the LEDs in an otherwise similar LED-based light with a lens formed from a housing having a circular cross sectional profile. Although the description follows with general reference to the spatial aspects of light, it will be understood that the lens 114 of the LED-based light 110 could be additionally configured to modify, for instance, the spectral aspects of the light emanating from the LEDs 134.

Figure 11:
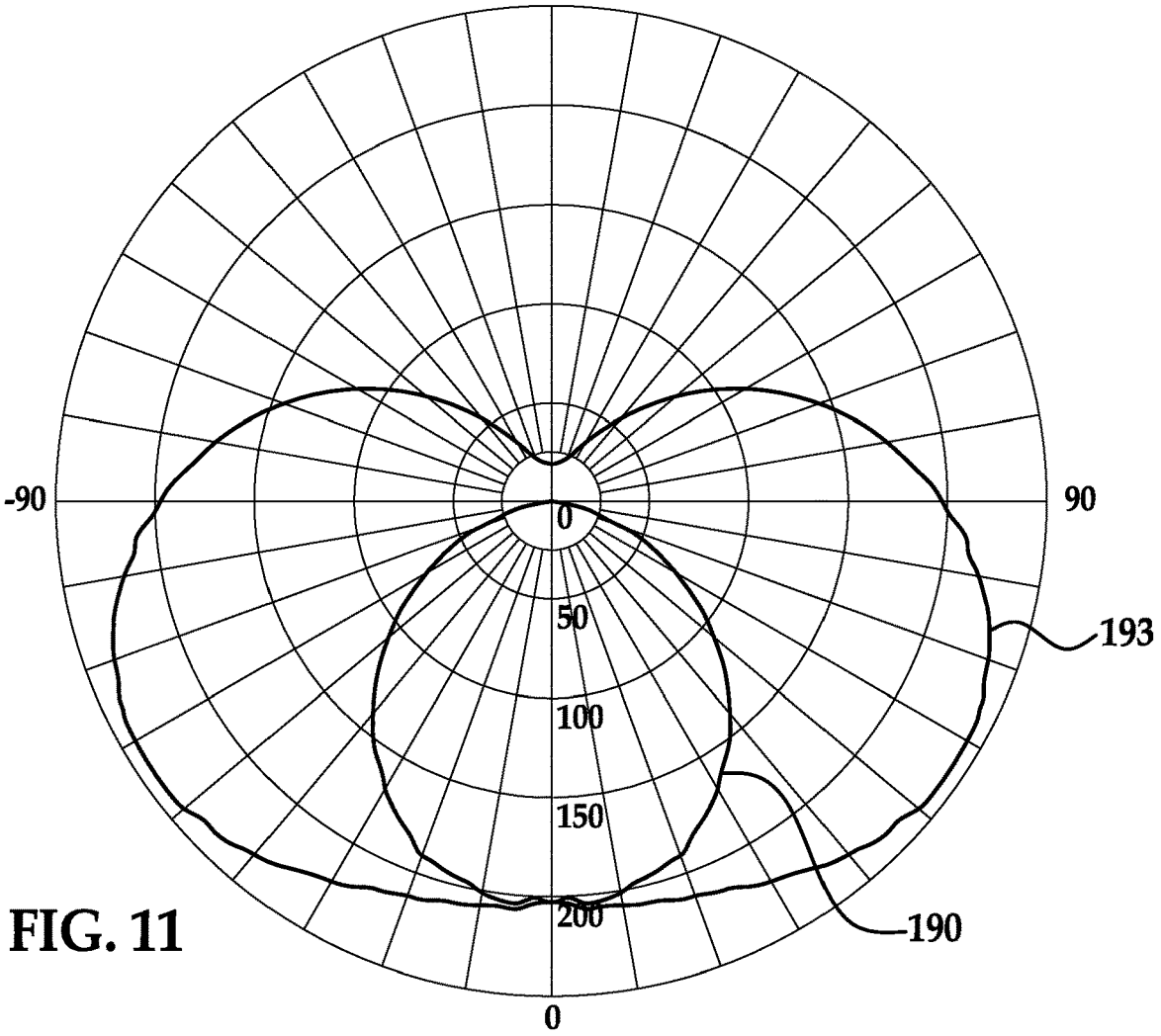
FIG. 11 is an example of a polar light distribution curve for the LED-based light of FIG. 7, shown with reference to the polar light distribution curve for a conventional LED-based light.

The light emanating from both the LEDs 134 in the LED-based light 110 and the LEDs in the otherwise similar LED-based light with a lens formed from a housing having a circular cross sectional profile may be generally directional. In the otherwise similar LED-based light, the generally directional nature of the LEDs may be substantially maintained as the light is transmitted through the lens. An example of a resulting light distribution 190 for the otherwise similar LED-based light is shown in FIG. 11. As shown, for this LED-based light, the light emanating from the LEDs is generally directionally distributed in a direction normal to the LEDs (i.e., along 0°), and little if any of the light emanating from the LEDs is distributed in a direction opposite the LEDs.

In the LED-based light 110, the lens 114 may generally be configured to redistribute some or all of the light emanating from the LEDs 134 away from the direction normal to the LEDs 134. For example, as shown in the light distribution 193 in FIG. 11, the light transmitted from the lens 114 may have a "batwing" configuration, or, a configuration with relatively more distribution of light away from 0° as compared to the light distribution 190 achieved with the otherwise similar LED-based light with a lens formed from a housing having a circular cross sectional profile. Further, due in part to the arrangement of the LED circuit board 130 at the base 180 of the housing 112, the light transmitted from the lens 114 may have a configuration with relatively more distribution of light away from 0° as compared to the light distribution 92 achieved with the LED-based light 10.

Figure 12A:
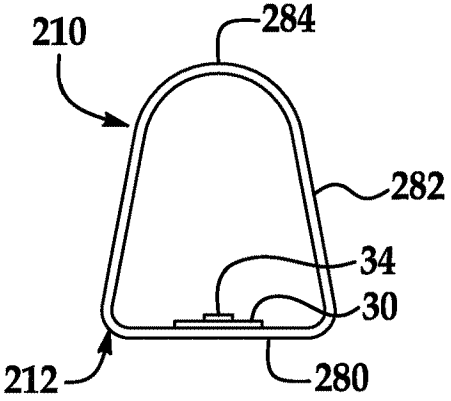
FIGS. 12A-H are cross sections of alternative examples of LED-based lights.
Figure 12B:
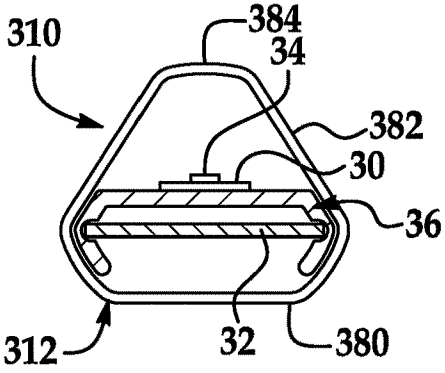
Figure 12C:
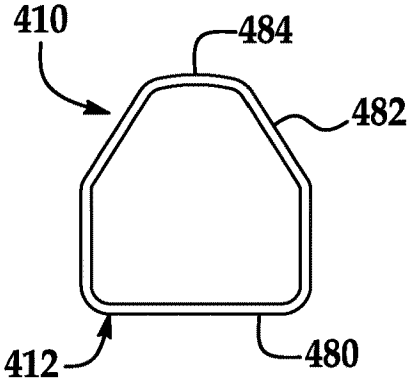
Figure 12D:
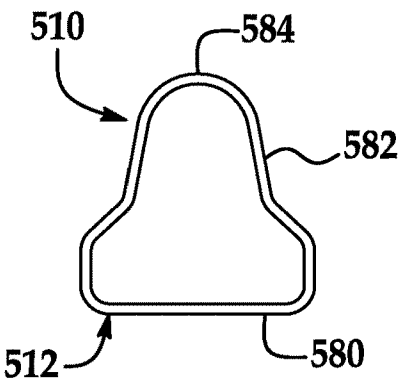
Figure 12E:
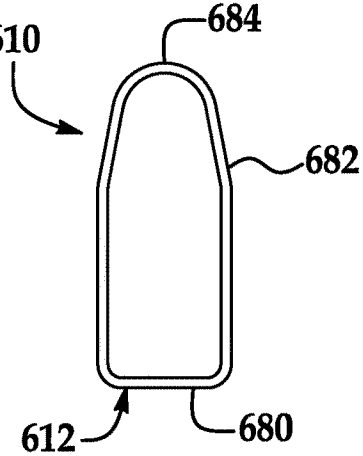
Figure 12F:
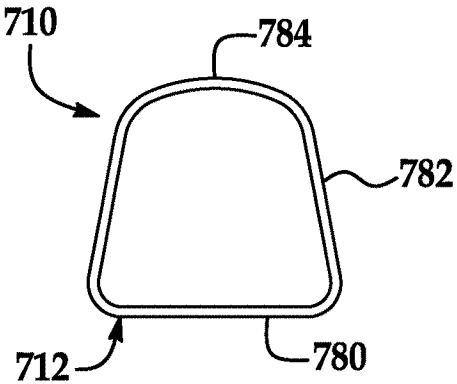
Figure 12G:
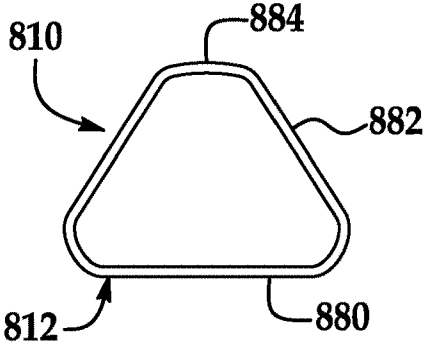
Figure 12H:
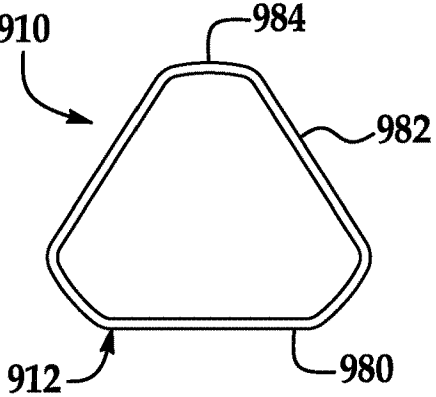

Alternative examples of LED-based lights 210, 310, 410, 510, 610, 710, 810, 910, where the lenses 214, 314, 414, 514, 614, 714, 814, 914 are formed by a rounded crown 284, 384, 484, 584, 684, 784, 884, 984 and adjoining distal portions of opposing canted outer walls 282, 382, 482, 582, 682, 782, 882, 982, are shown in FIGS. 12A-H. In these examples, the configurations of the housings are substantially as described above for the LED-based light 10 and the LED-based light 110. The examples may accommodate the support of the LED circuit boards as described with respect to LED-based lights 10, 110 using the support 36 as described or the base or bottom surface of the housing 112. By means of example only, FIG. 12A illustrates the LED circuit board 30 supported by the base surface 280 of the housing 212. By means of example only, FIG. 12B illustrates the LED circuit board 30 supported by the support 36, with the support 36 also supporting the power supply circuit board 32.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

We claim:

1. An LED-based light comprising:

an elongate tubular housing having longitudinal axis and a vertical axis orthogonal to the longitudinal axis, wherein the housing defines an outer periphery of the LED-based light and a cavity, wherein the housing comprises a base, a first canted outer wall, and a second canted outer wall, and wherein a surface of each of the base, the first canted outer wall, and the second canted outer wall defines a substantially identical arced profile in cross-section orthogonal to the longitudinal axis;

an LED circuit board positioned within the cavity;

a plurality of LEDs positioned on the LED circuit board;

end caps positioned at opposite ends of the housing, wherein each end cap comprises a respective bi-pin connector protruding from the end cap, the bi-pin connectors being compatible with a fluorescent light fixture; and a support enclosed by the housing, the support comprising a planar portion and two sidewalls extending from opposing ends of the planar portion, each sidewall being contoured to and aligned flush against a respective curved interior portion of the housing, and the LED circuit board being positioned on the planar portion.

2. The LED-based light of claim 1, wherein the surfaces of the base, the first canted outer wall, and the second canted outer wall substantially form a triangle in cross-section orthogonal to the longitudinal axis.

3. The LED-based light of claim 1, wherein the surfaces of the base, the first canted outer wall, and the second canted outer wall substantially form an equilateral triangle in cross-section orthogonal to the longitudinal axis.

4. The LED-based light of claim 1, wherein the surface of the first canted outer wall defines a first profile in cross-section orthogonal to the longitudinal axis, the first profile extending from a top of the first canted outer wall to a point of intersection between the first canted outer wall and the base, wherein the first profile comprises a first section extending between a first point and a second point, wherein the first point is defined by a first line tangent to the housing and at a 45° angle from a horizontal line, and wherein the second point is defined by a second line tangent to the housing and at a 90° angle from the horizontal line, and wherein the first section is at least 30 percent of the first profile.

5. The LED-based light of claim 4, wherein the surface of the second canted outer wall defines a second profile in cross-section orthogonal to the longitudinal axis, the second profile extending from a top of the second canted outer wall to a point of intersection between the second canted outer wall and the base, wherein the second profile comprises a second section extending between a third point and a fourth point, wherein the third point is defined by a third line tangent to the housing and at a 45° angle from the horizontal line, and wherein the fourth point is defined by a fourth line tangent to the housing and at a 90° angle from the horizontal line, and wherein the second section is at least 30 percent of the second profile.

6. The LED-based light of claim 1, wherein the LED-based light is operable to emit light according to a light distribution profile, wherein the light distribution profile comprises a first portion protruding from the LED-based light in a first direction angled with respect to the vertical axis, and a second portion protruding from the LED-based light in a second direction angled with respect to the vertical axis.

7. The LED-based light of claim 1, wherein the support creates a bipartite configuration which splits the cavity into a first cavity and a second cavity.

8. The LED-based light of claim 7, wherein the LED circuit board is supported by the support in the first cavity.

9. The LED-based light of claim 8, further comprising a power supply circuit board positioned in the second cavity and supported by the support.

10. The LED-based light of claim 1, wherein the each sidewall defines a respective channel, and wherein the power supply circuit board is inserted in the channels.

* * * * *